US009601321B2

(12) United States Patent
Kaneko et al.

(10) Patent No.: US 9,601,321 B2
(45) Date of Patent: Mar. 21, 2017

(54) MASS SPECTROMETER AND METHOD

(71) Applicant: Hitachi High-Technologies Corporation, Minato-ku, Tokyo (JP)

(72) Inventors: Akihito Kaneko, Tokyo (JP); Yohei Kawaguchi, Tokyo (JP); Masuyuki Sugiyama, Tokyo (JP); Kazushige Nishimura, Tokyo (JP)

(73) Assignee: Hitachi High-Technologies Corporation, Tokyo (JP)

( * ) Notice: Subject to any disclaimer, the term of this patent is extended or adjusted under 35 U.S.C. 154(b) by 11 days.

(21) Appl. No.: 14/415,226

(22) PCT Filed: Jun. 14, 2013

(86) PCT No.: PCT/JP2013/066421
§ 371 (c)(1),
(2) Date: Jan. 16, 2015

(87) PCT Pub. No.: WO2014/041862
PCT Pub. Date: Mar. 20, 2014

(65) Prior Publication Data

US 2015/0206728 A1 Jul. 23, 2015

(30) Foreign Application Priority Data

Sep. 14, 2012 (JP) ..... 2012-203044

(51) Int. Cl.
*H01J 49/00* (2006.01)
*H01J 49/26* (2006.01)
*H01J 49/42* (2006.01)

(52) U.S. Cl.
CPC ..... *H01J 49/0036* (2013.01); *H01J 49/0009* (2013.01); *H01J 49/0022* (2013.01);
(Continued)

(58) Field of Classification Search
None
See application file for complete search history.

(56) References Cited

U.S. PATENT DOCUMENTS 5,572,022 A 11/1996 Schwartz et al.
2002/0042112 A1* 4/2002 Koster ..... B01J 19/0046 435/174

(Continued)

FOREIGN PATENT DOCUMENTS

CN 1885030 A 12/2006
CN 101883983 A 11/2010

(Continued)

OTHER PUBLICATIONS

International Search Report dated Jul. 9, 2013 with English translation (four (4) pages).
Japanese-language Written Opinion (PCT/ISA/237) dated Jul. 9, 2013 (three (3) pages).
Chinese-language Office Action issued in counterpart Chinese Application No. 201380037727.0 dated Jan. 28, 2016 (seven (7) pages).

*Primary Examiner* — Andrew Smyth
(74) *Attorney, Agent, or Firm* — Crowell & Moring LLP

(57) ABSTRACT

A measurement state in a mass spectrometer device is determined so that the measurement method for the next round of measurement can be automatically determined. The mass spectrometer device (1) is provided with: a first calculation unit (6) that calculates the total amount of ion in a mass spectrum; a second calculation unit (6) that calculates the half-value width of a representative peak selected from peaks appearing in the mass spectrum; and a control unit (7) that determines the measurement method for use in the next round of measurement on the basis of the total amount of ion and the half-value width of the representative peak.

14 Claims, 25 Drawing Sheets

(52) U.S. Cl.
CPC ..... *H01J 49/0027* (2013.01); *H01J 49/26* (2013.01); *H01J 49/4265* (2013.01)

(56) References Cited

U.S. PATENT DOCUMENTS

| | | | | |
|---|---|---|---|---|
| 2003/0218129 | A1* | 11/2003 | Rather | H01J 49/40 250/282 |
| 2006/0186332 | A1* | 8/2006 | Haase | H01J 49/067 250/288 |
| 2007/0023642 | A1 | 2/2007 | Altmayer | |
| 2009/0215103 | A1* | 8/2009 | Gorenstein | G01N 30/72 435/24 |
| 2010/0282965 | A1 | 11/2010 | Nishiguchi et al. | |
| 2011/0270566 | A1 | 11/2011 | Sawada et al. | |
| 2012/0305760 | A1* | 12/2012 | Blick | H01J 43/246 250/282 |
| 2013/0299688 | A1* | 11/2013 | Balogh | H01J 49/168 250/282 |

FOREIGN PATENT DOCUMENTS

| | | | | |
|---|---|---|---|---|
| JP | 4-296434 | A | | 10/1992 |
| JP | 8-129001 | A | | 5/1996 |
| JP | 08129001 | A | * | 5/1996 |
| JP | 2000-173532 | A | | 6/2000 |
| JP | 2004-251830 | A | | 9/2004 |

* cited by examiner

| | Ion source stable | Ion source unstable |
|---|---|---|
| Measurement stable | Perform determination calculation | Do not perform determination calculation + Invalidate determination calculation going back to TIC range |
| Measurement unstable | Do not perform determination calculation | |

MASS SPECTROMETER AND METHOD

TECHNICAL FIELD

The present invention relates to a mass spectrometer device and method.

BACKGROUND ART

For analyzing a sample using a mass spectrometer, introduction of an ionized sample is basically necessary. Thus, the ion source is disposed in a stage prior to the mass spectrometer. The ion source may be classified into various types according to their different ionization methods. For example, the ion source is classified into EI method, CI method, ESI method, and ACPI method. Regardless of which ion source is used, ion generation or the measurement state of the mass spectrometer may become unstable. In that case, adjustment of the ion source or the mass spectrometer is necessary.

In the following, a case in which ion generation or the measurement state of the mass spectrometer become unstable will be described with reference to a quadrupole ion trap mass spectrometer as an example. In this mass spectrometer, ions introduced from the ion source to an ion trap are trapped by an Rf electric field for only a certain time, and concentrated ions are successively ejected from the ion trap in accordance with their mass to charge ratio (m/z), and a change in the intensity value is detected by a detector so as to analyze the mass of the sample.

It is known that there is a limit to the amount of ion that can be trapped in the ion trap. It is also known that, even in a transitional status before the trapping-enabled limit amount is reached, a phenomenon referred to as a space charge effect (a phenomenon in which the apparent mass is displaced) occurs when the amount of ion exceeds a certain level. This phenomenon is caused by a displacement in the ion's pseudopotential due to the charge of the ion, affecting the mass analysis principle of the ion trap.

The mass spectrometer is normally used in a laboratory where the environment conditions such as temperature and humidity are constantly maintained. This is because if the environment conditions are changed, the measurement accuracy may be influenced by variation in the control circuit operation or a change in the physical length of the device, for example. Thus, generally, in order to maintain measurement accuracy, an operation such as calibration or sensitivity confirmation is performed before measurement. As needed, adjustments, washing, device parameter modifications and the like may also be performed. Measurement of the concentration of the sample as the object of measurement and preliminary measurement, namely a sample preprocessing, concentration adjustment, measurement condition optimization and the like may also be performed. Such preparation work is normally conducted by a person having knowledge of chemical experimentation or mass analysis, or under the supervision of such personnel.

CITATION LIST

Patent Literature

Patent Literature 1: Specification of U.S. Patent Application Publication No. 2011/0270566

SUMMARY OF INVENTION

Technical Problem

Practical application of a mass spectrometer that can be carried to locations other than the laboratory is being studied. For example, practical application of a mass spectrometer for use in the analysis of drugs, dangerous material, discharged gas, environmental material, foodstuff and the like is being studied. This type of mass spectrometer is used at the site of investigation where the sample as the object of measurement is collected or suctioned, and required to be capable of immediately identifying the substance constituting the sample.

However, when the mass spectrometer is used at the site of investigation, the environment conditions that have been maintained in the laboratory may not be available, or the environment conditions may vary. Further, the site of investigation generally lacks in experimental facility. Thus, there is the possibility that the adjustment of the concentration of the sample as the object of measurement or measurement condition optimization cannot be performed in advance. Not only that, there is also the possibility that the user of the mass spectrometer lacks the knowledge of chemical experiment or mass analysis.

Thus, particularly in the case of a portable mass spectrometer, installation of a function for automatically determining and dealing with environment condition variations or a side effect arising from the variations is desirable. The installation of an equivalent function in the case of a mass spectrometer device used in the laboratory and the like is also considered to be useful in increasing measurement accuracy or decreasing the burden on the user.

Patent Literature 1 discloses a method where an operator performs measurement parameter optimization or measurement parameter selection based on actual measurement data that has been filed. However, in Patent Literature 1, there is no disclosure as to a method for the device itself to execute an equivalent process during measurement, or a method for automatically eliminating environment condition instability.

Solution to the Problem

In order to solve the problem, the present invention adopts the configurations set forth in the claims, for example. The present specification includes a plurality of means for solving the problem. One example is a mass spectrometer device including a first calculation unit that calculates a total amount of ion in a mass spectrum; a second calculation unit that calculates a half-value width of a representative peak selected from peaks appearing in the mass spectrum; and a control unit that determines a measurement method for use in a next round of measurement, on the basis of the total amount of ion and the half-value width of the representative peak.

Advantageous Effects of Invention

According to the present invention, a mass spectrometer device capable of automatically determining the measurement method for use in the next round of measurement can be realized. As a result, even under an environment such that measurement conditions such as an environment condition or a sample concentration are varied, mass analysis can be stably executed. Other problems, configurations, and effects will become apparent from the following description of embodiments.

DESCRIPTION OF EMBODIMENTS

In the following, modes of carrying out the present invention will be described with reference to the drawings. The modes of carrying out the present invention are not limited to the embodiments described below, and various modifications may be made within the technical scope of the present invention.

First Embodiment (Overall Configuration of Device, and Outline of Process Operation)

Figure 1:
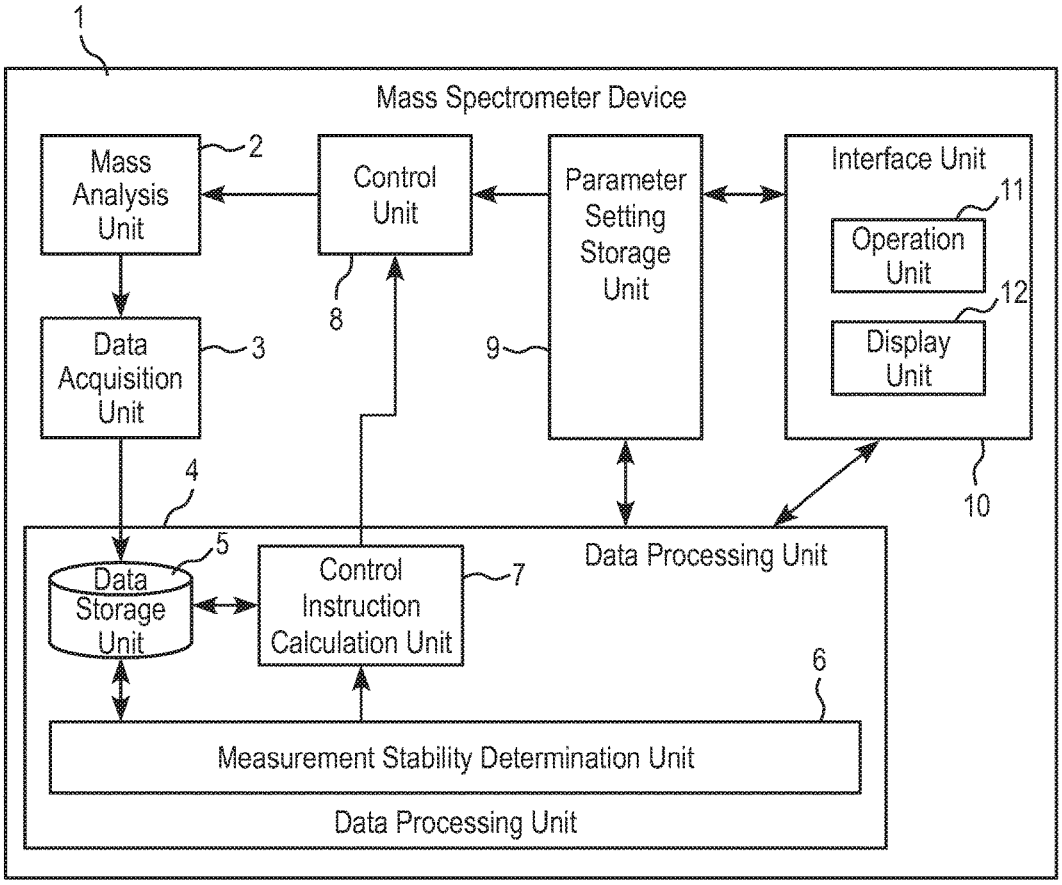
FIG. 1 illustrates the configuration of a mass spectrometer device according to a first embodiment.

FIG. 1 illustrates a configuration example of a mass spectrometer device provided with a function of determining measurement state stability based on the total amount of ion and the half-value width of a representative peak of a mass spectrum, and then automatically determining a measurement method for use in the next round of measurement based on the result of the stability determination.

A mass spectrometer device 1 includes a mass analysis unit 2; a data acquisition unit 3; a data processing unit 4; a control unit 8; a parameter setting storage unit 9; and an interface unit 10. The mass analysis unit 2 includes an ion source, an analysis unit with an ion trap, and a detector. The present invention is applicable regardless of the type of ion source or ion trap. The data processing unit 4 includes a data storage unit 5; a measurement stability determination unit 6; and a control instruction calculation unit 7. The interface unit 10 includes an operation unit 11 and a display unit 12.

A user of the mass spectrometer device 1 inputs measurement parameters by operating the operation unit 11 of the interface unit 10. The measurement parameters include, for example, the type of a sample as the object of measurement, and a sample measurement condition. The measurement parameters may be input via selection or direct input. The input parameters are stored in the parameter setting storage unit 9.

The mass spectrometer device 1 starts sample measurement on condition that the measurement start condition set in advance is met. The measurement start condition may be the setting of a sample in the mass analysis unit 2, or the input of a measurement start instruction by the user after the sample is set. In the case of a mass spectrometer device that does not require the setting of sample, namely, when the mass spectrometer device performs measurement by suctioning ambient air from the peripheral environment, a measurement start input from the interface unit 10 may provide the measurement start condition. The measurement start condition may also be provided by the elapse of a pre-designated time since the point in time of parameter input.

After the start of a measurement sequence, the mass analysis unit 2 measures the components of the sample as the object of measurement, and outputs resultant measurement data (mass spectrum data) to the data acquisition unit 3. The data acquisition unit 3 outputs the measurement data acquired from the mass analysis unit 2 to the data processing unit 4. The data processing unit 4 stores the measurement data in the data storage unit 5 together with time information. The measurement data and the time information are read from the data storage unit 5 and fed to the measurement stability determination unit 6.

Figure 2:
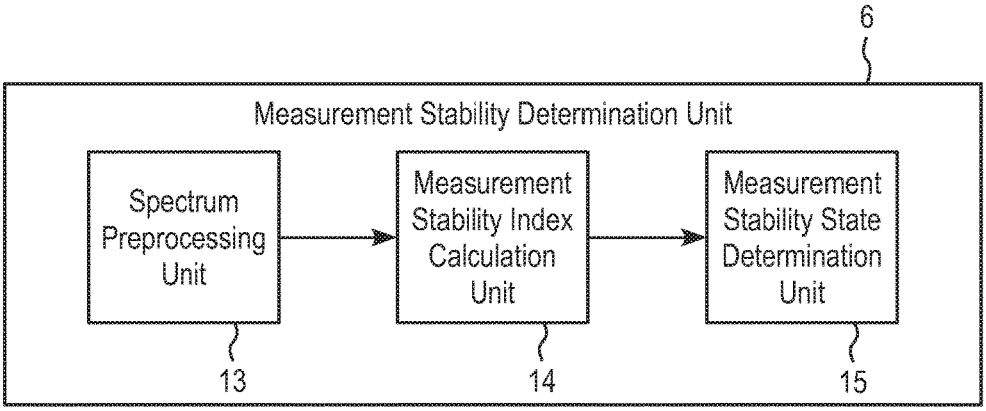
FIG. 2 illustrates the inner configuration of a measurement stability determination unit.

FIG. 2 illustrates the inner configuration of the measurement stability determination unit 6. The measurement stability determination unit 6 includes a spectrum preprocessing unit 13, a measurement stability index calculation unit 14, and a measurement stability state determination unit 15. The measurement data input to the measurement stability determination unit 6 are processed in the order of the spectrum preprocessing unit 13, the measurement stability index calculation unit 14, and the measurement stability state determination unit 15.

In the spectrum preprocessing unit 13, preprocessing is performed with respect to each spectrum. In the case of the present embodiment, a base line removal process, a peak detection process and the like are executed as the preprocessing. In the measurement stability index calculation unit 14, a process of calculating a stability index is performed. In the case of the present embodiment, as the stability index, the total amount of ion in the mass spectrum and the half-value width of a peak representing the mass spectrum are calculated. In the measurement stability determination unit 15, stability is determined on the basis of the calculated stability index. The result of determination is output to the control instruction calculation unit 7.

The control instruction calculation unit 7 calculates the measurement method for use in the next round of measurement on the basis of the input result of determination, and provides the control unit 8 with an instruction.

(Details of the Content of Spectrum Preprocessing)

Here, the details of the content of spectrum preprocessing executed in the spectrum preprocessing unit 13 of the measurement stability determination unit 6 will be described. In spectrum preprocessing, a base line removal process and a peak detection process are executed.

Figure 3:
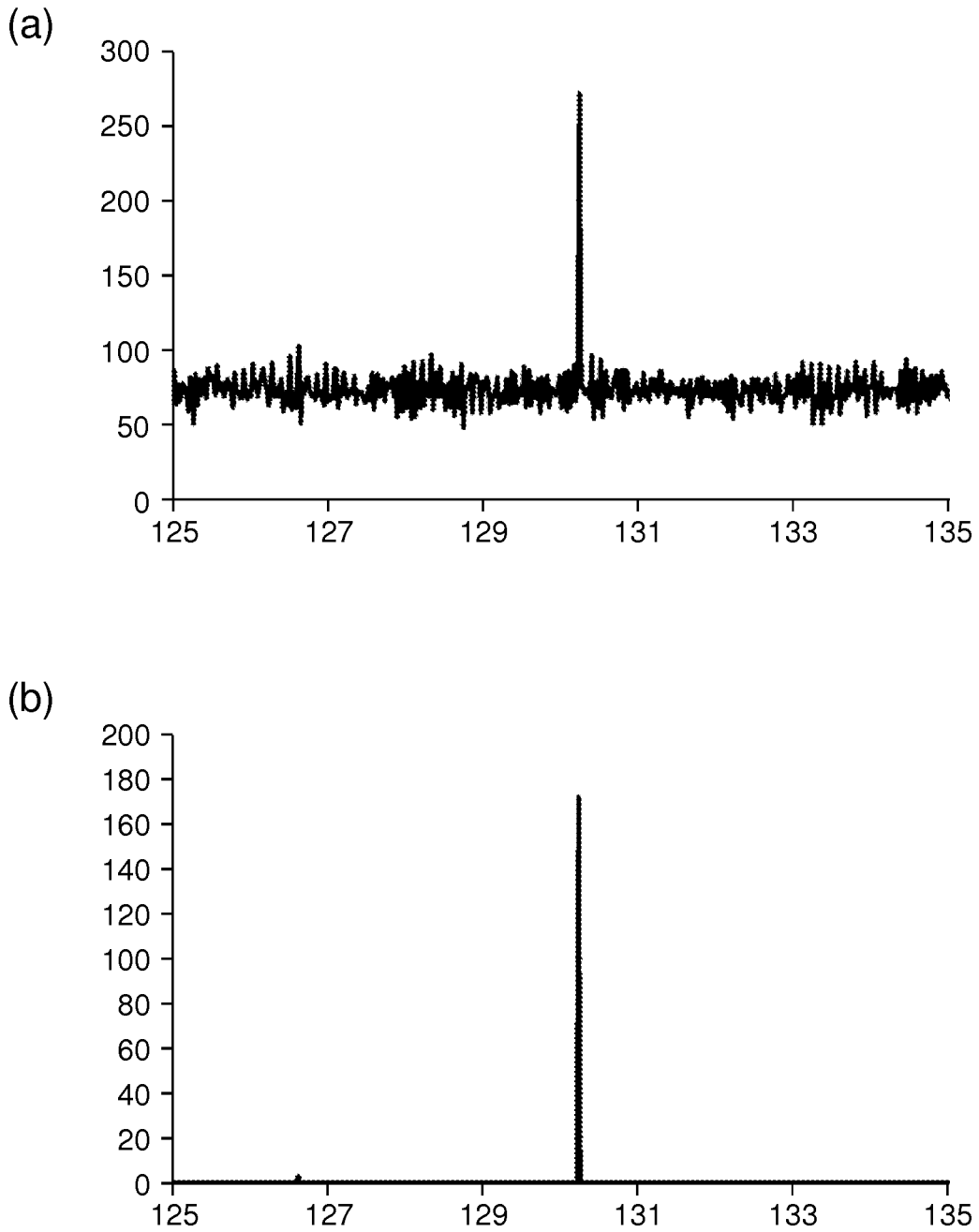
FIGS. 3*a* and 3*b* illustrate an example of a spectrum before and after base line removal.

FIG. 3(*a*) illustrates an example of a spectrum prior to the base line removal process. In the case of the example of FIG. 3(*a*), portions where the peak is not present have substantially constant spectrum values. Thus, it is thought that the waveforms appearing in the portions represent a constant level of electric noise generated in the detector. Namely, it can be considered that the spectrum values in the portions are constant values determined irrespective of measurement. The constant values are referred to as a base line. Thus, in the base line removal process, a process of removing the base line from each measurement spectrum is executed.

The base line can be calculated as an average value of respective maximum values in a plurality of mass spectra measured in a state with no introduction of ions, for example. However, when the value after removing the base line becomes negative, zero is used as a constant providing the base line. In some cases, the spectrum in the portions where no peak is present may not indicate a constant trend. In such a case, the base line may be determined by various known methods that have been devised.

Figure 4:
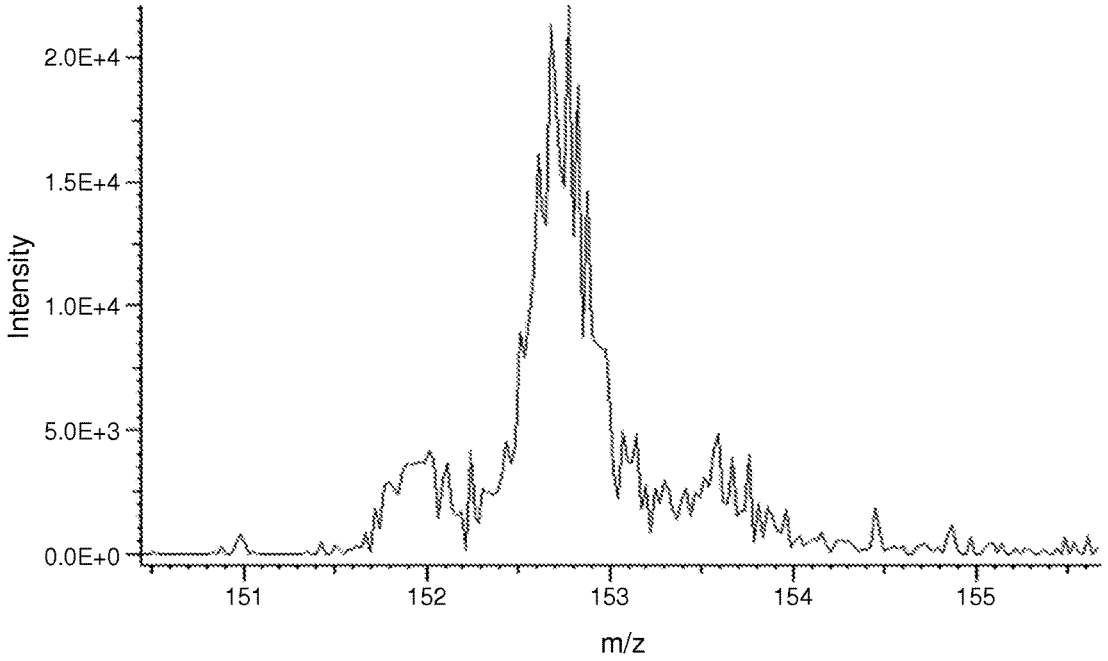
FIG. 4 illustrates an example of a spectrum before smoothing.
Figure 5:
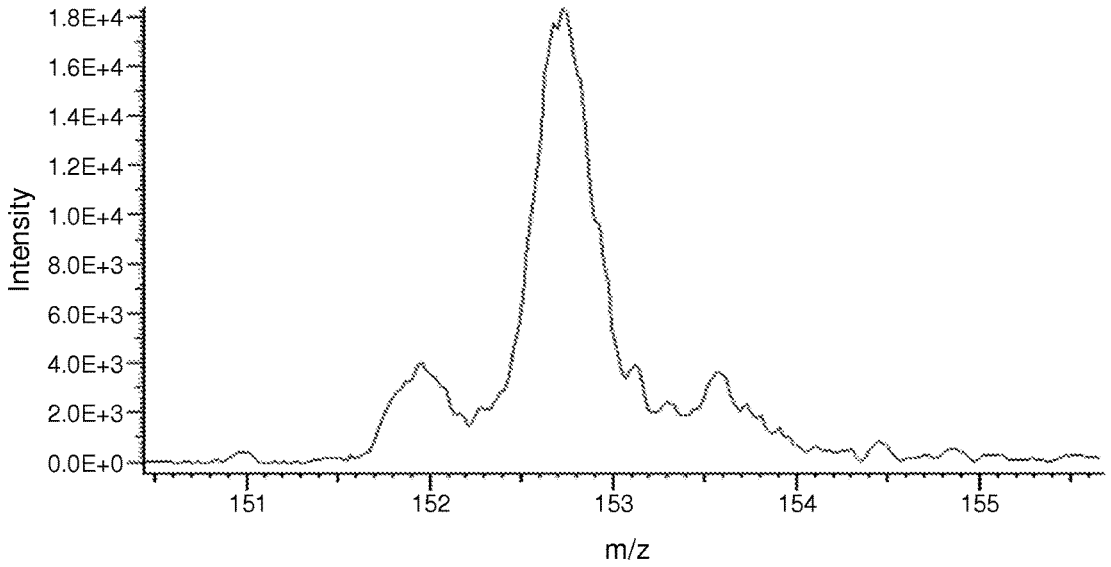
FIG. 5 illustrates an example of the spectrum after smoothing.

After the base line removal process, the spectrum preprocessing unit 13 performs, with respect to the mass spectrum after base line removal, a polynomial smoothing process, such as moving average method, convolution by Gaussian function, or Savizky-Golay method. FIG. 4 illustrates an example of the mass spectrum prior to smoothing. FIG. 5 illustrates an example of the mass spectrum after smoothing by Savizky-Golay method.

After the smoothing process, the spectrum preprocessing unit 13 calculates a differential series with respect to the mass spectrum data after smoothing, and selects the point at which the differential value changes from positive to negative as a peak of the mass spectrum. During the peak detection process, noise may be removed in advance using a digital filter and the like. The mass spectrum peak may be detected by applying a totally different known peak detection method.

After the spectrum preprocessing is executed, in the data storage unit 5, there are stored (1) the mass spectrum after base line removal; (2) the mass spectrum that has been smoothed after base line removal; and (3) a list of detected peaks. After the spectrum preprocessing is completed, the measurement stability determination unit 6 calculates a measurement stability index using the measurement stability index calculation unit 14.

(Detailed Content of Stability Index Calculation Process)

Figure 6:
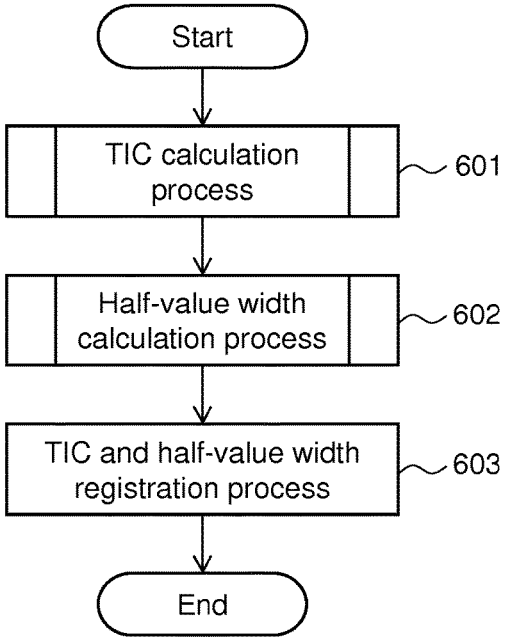
FIG. 6 illustrates the outline of a process procedure executed by a measurement stability index calculation unit.

Here, the details of the measurement stability index calculation process performed by the measurement stability index calculation unit 14 of the measurement stability determination unit 6 will be described. FIG. 6 illustrates the outline of the process operation. The measurement stability index calculation process includes a process of calculating the total amount of ion in the mass spectrum (step 601); a process of calculating the half-value width of the mass spectrum (step 602); and a process of registering the calculated total amount of ion and half-value width (step 603). The total amount of ion and the half-value width are registered in the data storage unit 5.

Figure 7:
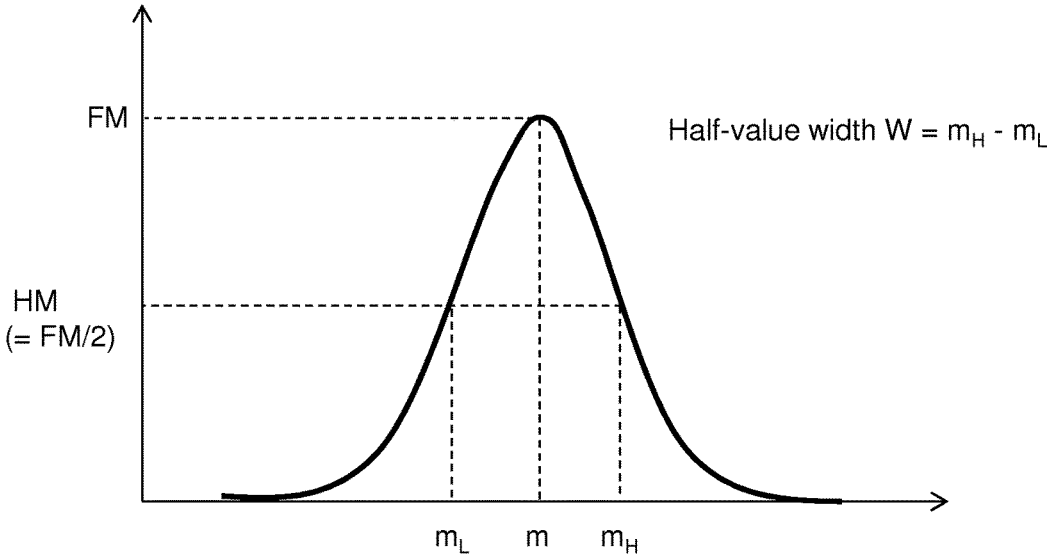
FIG. 7 is a chart for describing the definition of a half-value width.

Generally, "TIC", which indicates the total amount of ion, is used as an acronym for "Total Ion Chromatogram" or "Total Ion Current". In the present specification, TIC is defined as the total amount of ion observed with respect to a certain mass spectrum of interest. The half-value width is defined as a differential value of the left and right m/z values of a certain peak waveform that provide the half value of the intensity value (maximum value) of the peak waveform (FIG. 7). In FIG. 7, the intensity value is indicated by FM, its half value by HM, the left-side (lower) m/z value corresponding to the half value by $m_L$, and the right-side (higher) m/z value corresponding to the half value by $m_H$. In this case, the half-value width is provided by $m_H-m_L$.

The half-value width has a relationship with an index representing device resolution in mass analysis. When the resolution of a certain peak is R, the m/z value corresponding to the peak is m, and the half-value width is W, the resolution R is defined by expression 1.

$$R=m/W(\text{at } m) \quad \text{(Expression 1)}$$

Specifically, in the case of a device where the resolution R is expected as a performance index, the expected half-value width W can be calculated according to expression 1. It should be noted, however, that the resolution R in a strict sense is defined by a certain mass number. Therefore, the resolution R may be constant at the mass number in the measurement range, or the resolution R may vary depending on the mass number. When the resolution R varies, it is necessary to use the resolution R in accordance with the mass number.

Figure 8:
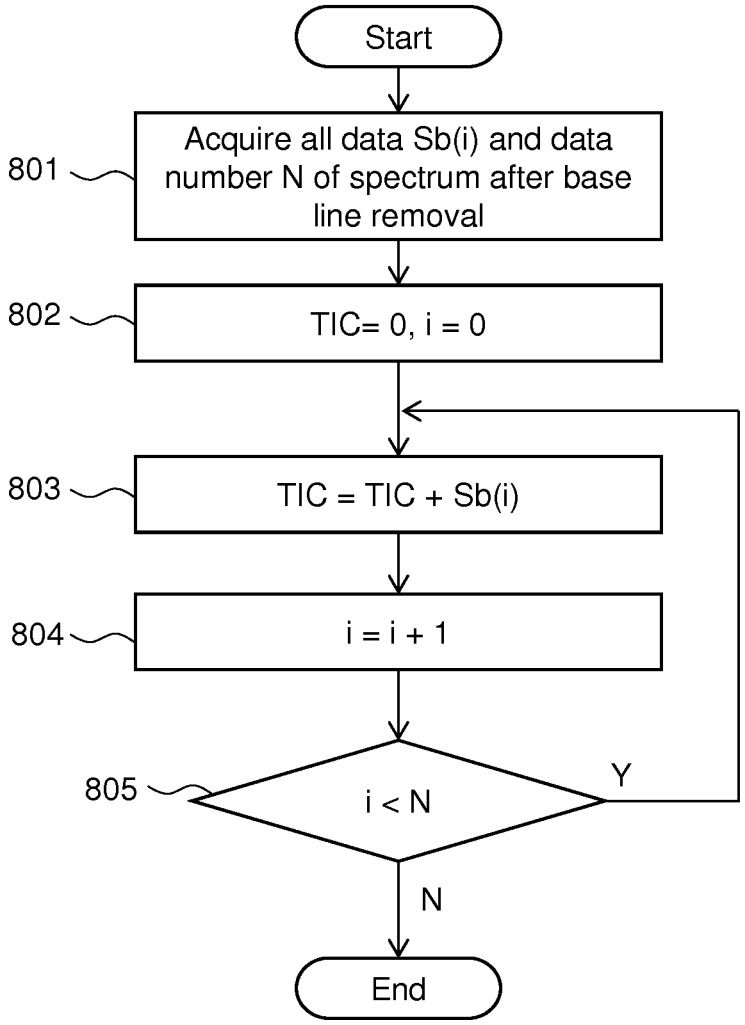
FIG. 8 is a chart for describing a TIC calculation process.

FIG. 8 illustrates the outline of the process operation executed in a TIC calculation process (step 601). The TIC calculation process, simply put, is a process of determining an integrated value in the entire range of the mass spectrum after base line removal. Thus, the measurement stability index calculation unit 14 acquires from the data storage unit 5 all of data Sb(i) of the mass spectrum after base line removal and the number of data N (step 801), and executes the process from step 802 to step 805. Step 802 is an initialization process. Step 803 is a process of adding the i-th data Sb(i) to TIC, which is the integrated value up to the i−1th data.

TIC is a value giving the total amount of ion observed as a mass spectrum in the detector, and not a value giving the total amount of ion present within the ion trap. Thus, TIC does not represent the total amount of ion trapped in the ion trap unless the m/z range of ion trapped in the ion trap and the m/z range of ion observed by the detector correspond to each other.

However, it is generally not known whether the m/z range of ion trapped in the ion trap corresponds to the m/z range of ion observed by the detector. Thus, a phenomenon due to the total amount of ion present in the ion trap cannot be evaluated only with the TIC information. An example of the phenomenon due to the total amount of ion present in the ion trap is a space charge effect. The space charge effect refers to a phenomenon in which the sample mass spectrum appears shifted from its inherent position depending on the total amount of the entire ion trapped in the ion trap. In order to evaluate the mass spectrometer measurement accuracy, the amount of influence of the space charge effect needs to be known. However, as described above, the influence of the space charge effect cannot be accurately known with only the TIC information.

Figure 9:
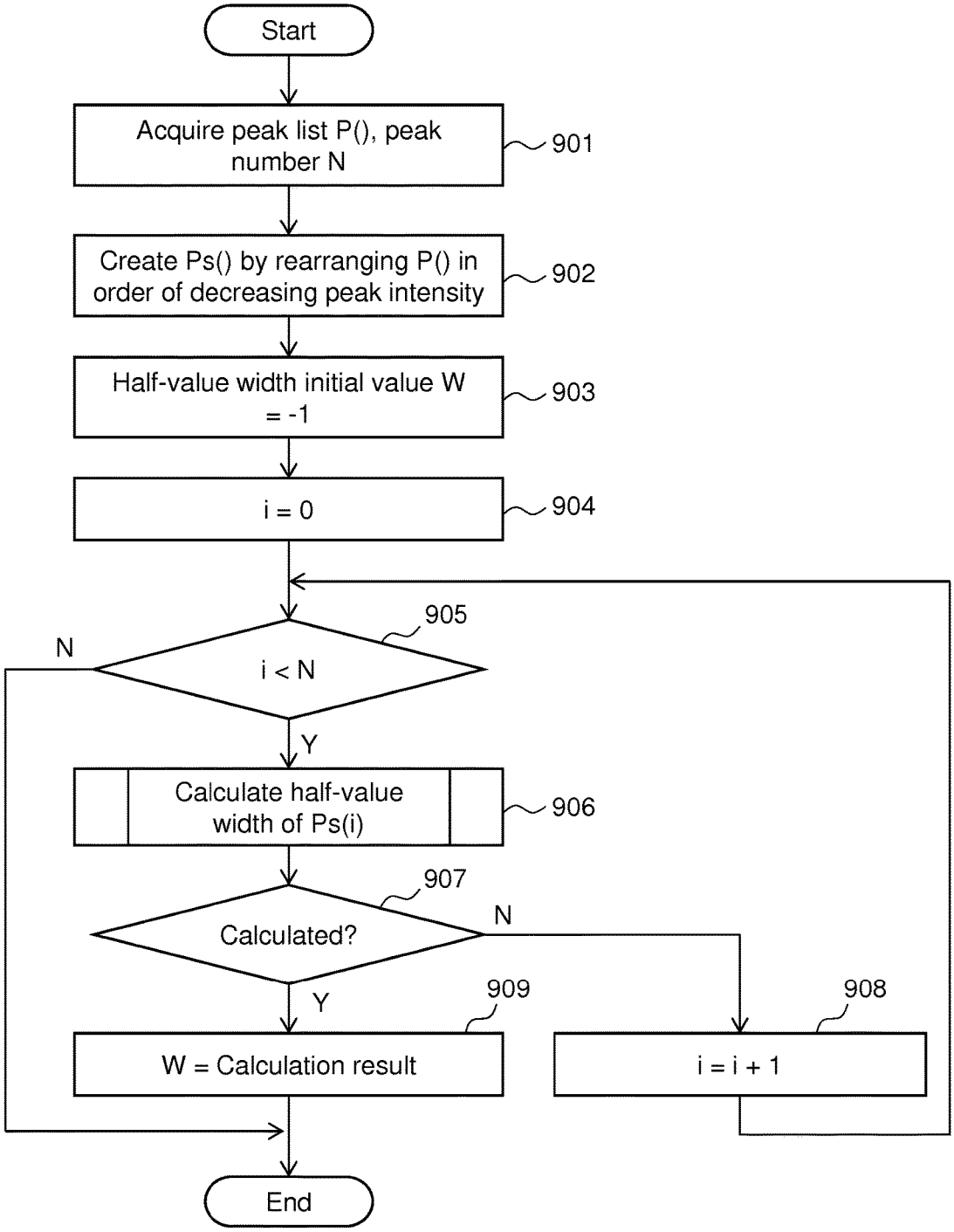
FIG. 9 is a chart for describing a half-value width calculation process.

Thus, in the mass spectrometer according to the present embodiment, as one of measurement stability indexes, the half-value width of a representative peak is also used. FIG. 9 illustrates the details of a process operation executed in the half-value width calculation process (step 602).

The measurement stability index calculation unit 14 initially acquires from the data storage unit 5 a peak list PO and the number N of peaks calculated in the spectrum preprocessing unit 13 (step 901). The measurement stability index calculation unit 14 creates a list Ps( ) in which the peaks in the peak list P( ) are rearranged in the order of decreasing peak intensity (step 902). An initial value for the half-value width W is set (step 903). In the case of the present embodiment, an invalid value "−1" is set as the initial value of the half-value width W. A parameter i giving the peak intensity order is set to an initial value "0" (step 904).

Thereafter, the measurement stability index calculation unit 14 calculates the half-value width W of the peaks in order from the top of the list Ps( ) (step 906). If the half-value width W can be calculated (affirmative result in step 907), the calculated value is substituted in the half-value width W, and the process ends at that point in time (step 909). If the half-value width W cannot be calculated for all of the peaks (negative result in step 905), the measurement stability index calculation unit 14 outputs "−1" as the half-value width W of the representative peak.

Figure 10:
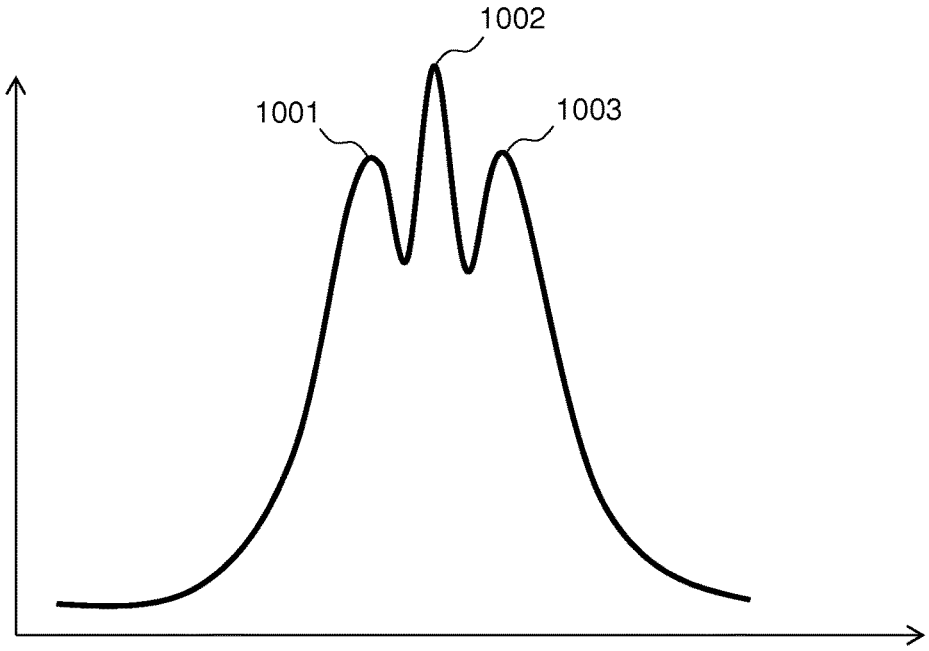
FIG. 10 illustrates an example in which the half-value width cannot be calculated because of proximate peaks.

In the present embodiment, the half-value width is calculated in the order of decreasing peak intensity for the reason that, when the peaks are close to each other, for example, it may not be always possible to calculate the half-value width W of the maximum peak. For example, in the case of FIG. 10, of the three peaks, a peak 1002 positioned at the center has the largest intensity, with a peak 1001 and a peak 1003 overlapping the peak 1002. As a result, the half-value width W of the peak 1002 cannot be calculated. Thus, when the waveforms of a plurality of peaks overlap each other, the left and right m/z values giving the half value HM of the peak intensity value FM cannot be identified, so that the half-value width W cannot be calculated. In the case of FIG. 10, the half-value width W cannot be calculated for the first and the third peaks 1001 and 1003, either, for the same reason.

Figure 11:
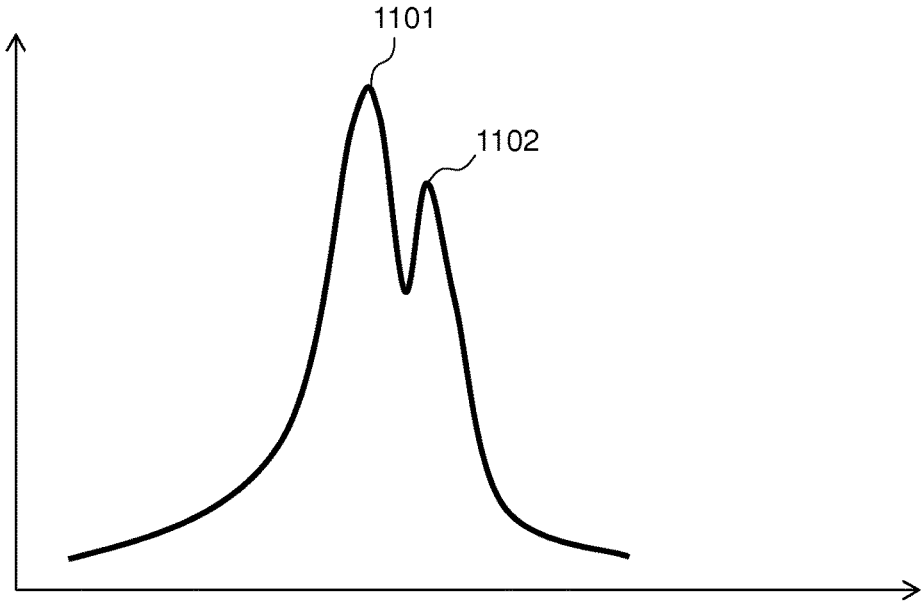
FIG. 11 illustrates an example in which the half-value width can be calculated even when there are proximate peaks.

Thus, according to the present embodiment, a calculation method for enabling the calculation of the half-value width W for more peaks is proposed. Specifically, a half-value width calculation method using the half width at half maximum is proposed. The calculation method will be described with reference to FIG. 11. FIG. 11 shows a mass spectrum in which two peak waveforms are overlapping. In the case of this example, too, the half-value width cannot be calculated by the conventional calculation method. However, by the calculation method utilizing the half width at half maximum, the half-value width can be calculated for both a peak 1101 and a peak 1102. With regard to the peak 1101, a value twice the left-side half width at half maximum is defined as the half-value width W of the peak 1101. With regard to the peak 1102, a value twice the right-side half width at half maximum is defined as the half-value width W of the peak 1102.

Figure 12:
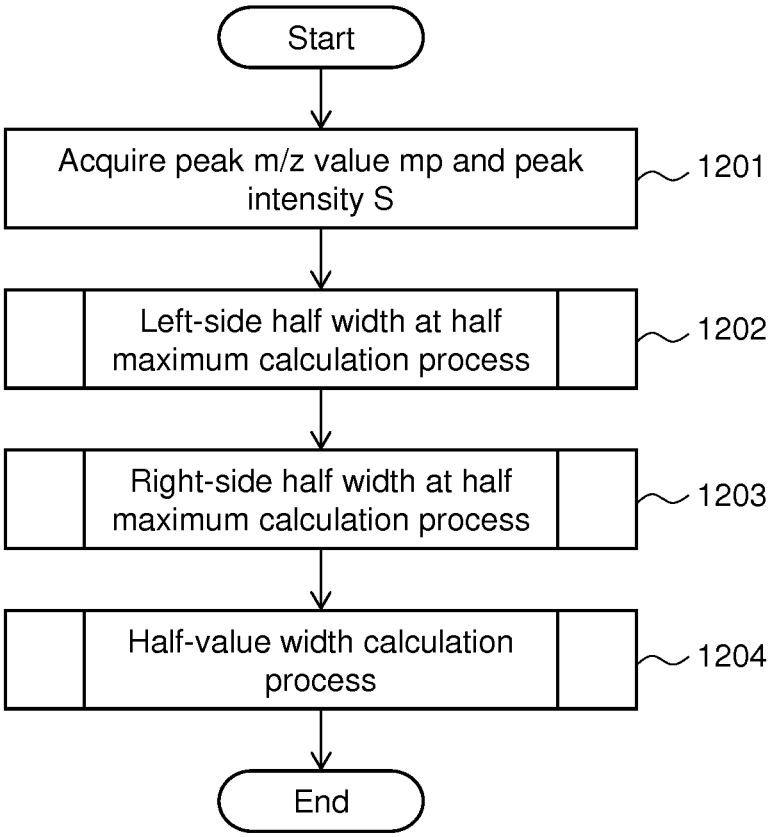
FIG. 12 is a chart for describing a half-value width calculation process for a certain peak.

FIG. 12 illustrates the content of the half-value width W calculation process utilizing the half width at half maximum. In the case of the present embodiment, the process of FIG. 12 is executed as the process of step 906.

First, the measurement stability index calculation unit 14 acquires information of a peak of interest (the m/z value mp of the peak and peak intensity S) (step 1201). Then, the measurement stability index calculation unit 14 calculates the left-side (i.e., low-mass side) half width at half maximum of the peak of interest (step 1202). Here, the left-side half width at half maximum is provided by the differential $mp-m_L$ between the left-side m/z value $m_L$ that has the half value of the peak intensity S, and the m/z value mp of the peak. The measurement stability index calculation unit 14 also calculates the right-side (i.e., high-mass side) half width at half maximum of the peak of interest (step 1203). Here, the right-side half width at half maximum is provided by the differential $m_H-mp$ between the right-side m/z value $m_H$ that has the half value of the peak intensity S, and the m/z value mp of the peak. Either step 1202 or step 1203 may be processed first.

Thereafter, the measurement stability index calculation unit 14 calculates the half-value width of the peak of interest on the basis of the left-side half width at half maximum or the right-side half width at half maximum (step 1204). Specifically, a value twice the smaller of the half widths at half maximum that could be calculated is considered the half-value width W of the peak of interest. It is noted that when the calculation process shown in FIG. 12 is applied to the mass spectrum of FIG. 10, the half-value width W of each peak can be calculated even when the half width at half maximum can be calculated only for the low-mass side, such as for the peak 1001, or when the half width at half maximum can be calculated only for the high-mass side, such as for the peak 1003.

Figure 13:
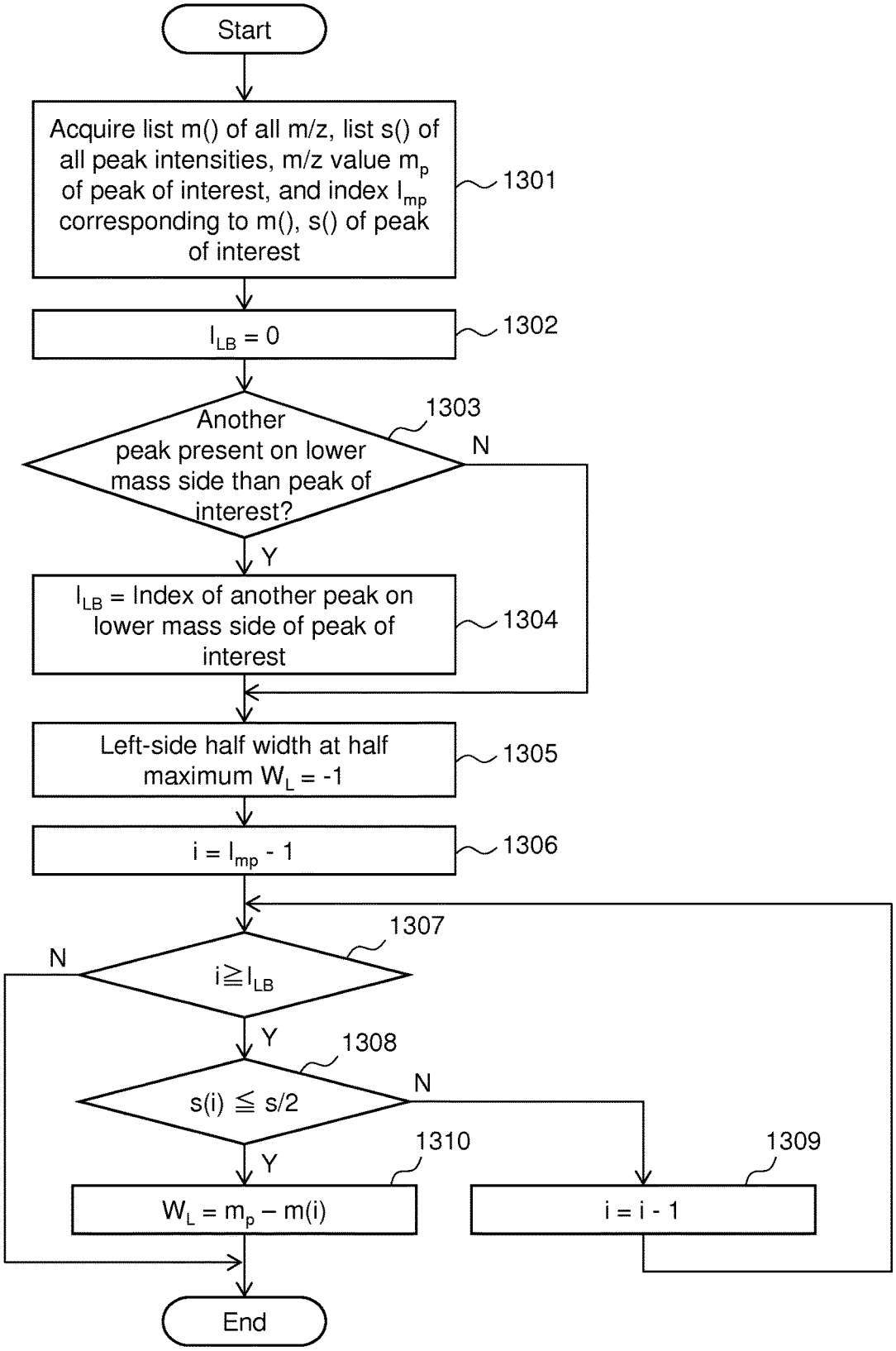
FIG. 13 is a chart for describing a left-side (low-mass side) half width at half maximum calculation process.

FIG. 13 shows the details of the calculation process executed in step 1202 (i.e., the low-mass side half width at half maximum calculation process). First, the measurement stability index calculation unit 14 acquires a list m( ) of all m/z, a list s( ) of all peak intensities, the m/z value $m_p$ of the peak of interest, and an index $I_{mp}$ corresponding to the m( ) and the S( ) of the peak of interest (step 1301). The list m( ) is a set of the m/z values as the object of measurement of intensity value. The list s( ) is a set of measured intensity values. The index $I_{mp}$ is a value giving the position of the m/z value giving the maximum intensity of the peak of interest on the list m( ).

The measurement stability index calculation unit 14 then sets $I_{LB}$ to zero (step 1302). The index $I_{LB}$ is the position, on the list m( ), of the m/z value giving the lower limit of a determination range of the left-side half width at half maximum with respect to the peak of interest. Thereafter, the measurement stability index calculation unit 14 determines whether there is another peak on the low-mass side than the peak of interest (step 1303). If an affirmative result is obtained, the measurement stability index calculation unit 14 proceeds to step 1304. If a negative result is obtained, the measurement stability index calculation unit 14 proceeds to step 1305.

In step 1304 (when there is another peak on the lower-mass side than the peak of interest), the measurement stability index calculation unit 14 sets, as the index $I_{LB}$ value, an index of the other peak positioned on the lower-mass side than the peak of interest. The index of the other peak provides the determination range lower limit.

In step 1305, the measurement stability index calculation unit 14 sets the left-side half width at half maximum $W_L$ to −1. The step is performed so that, when the left-side half-value width $W_L$ cannot be calculated with respect to the peak of interest, a determination to that effect can be made in a subsequent step. Thus, an invalid value that is not adoptable as the half-value width W is set.

Then, the measurement stability index calculation unit 14 sets the index i providing the readout position of the list m( ) to a value "$I_1-1$" smaller than the index $I_{mp}$ corresponding to the peak of interest by one. Thereafter, the measurement stability index calculation unit 14 determines whether the index i is equal to or greater than the determination range lower limit value. If a negative result is obtained in step 1307 (when the index i is greater than the determination range), the left-side half width at half maximum calculation process (step 1202) is terminated at this point in time.

On the other hand, if an affirmative result is obtained in step 1307, the measurement stability index calculation unit 14 determines whether the intensity s(i) corresponding to the index i is equal to or smaller than the half value s/2 of the intensity of the peak of interest (step 1308). If the intensity s(i) is greater than the half value s/2, the measurement stability index calculation unit 14 obtains a negative result and proceeds to step 1309. In step 1309, the measurement stability index calculation unit 14 further modifies the index i to a value smaller by one. After the index i is updated, the measurement stability index calculation unit 14 returns to step 1307 and repeats the above-described determination process. If the intensity s(i) reaches the half value s/2 of the intensity of the peak of interest before the index i reaches the determination range lower limit, the measurement stability index calculation unit 14 obtains an affirmative result in step 1308, and proceeds to step 1310.

In step 1310, the measurement stability index calculation unit 14 calculates the left-side half width at half maximum $W_L$ of the peak of interest as a differential between the m/z value $m_p$ of the peak of interest and the m/z value m(i) corresponding to the index i.

Figure 14:
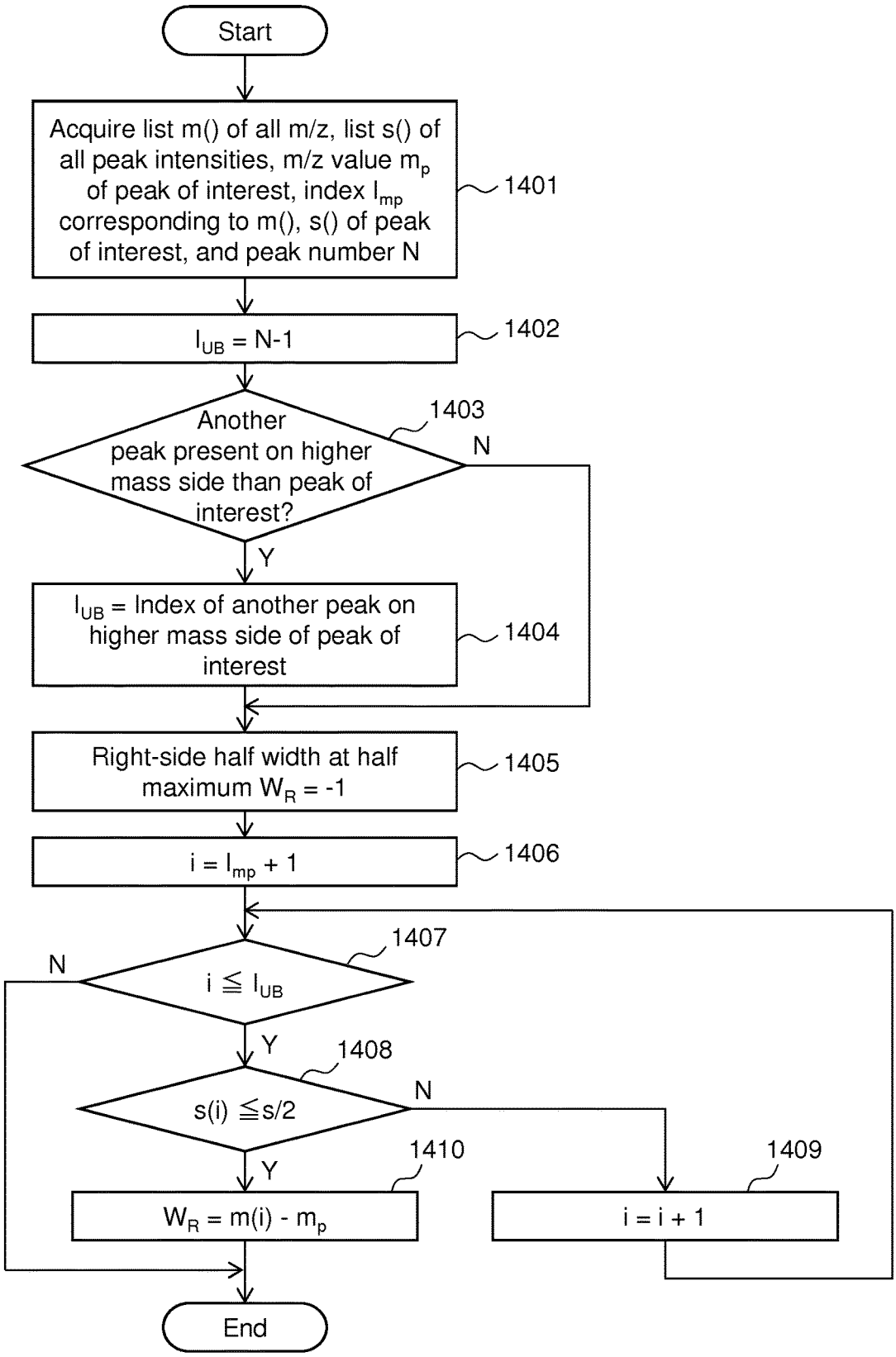
FIG. 14 is a chart for describing a right-side (high-mass side) half width at half maximum calculation process.

FIG. 14 shows the details of the calculation process (i.e., the high-mass side half width at half maximum calculation process) executed in step 1203. The basic process content is the same as in step 1202. First, the measurement stability index calculation unit 14 acquires the list m( ) of all m/z, the list s( ) of all peak intensities, the m/z value $m_p$ of the peak of interest, and the index $I_{mp}$ corresponding to the m( ) and the S( ) of the peak of interest (step 1401).

The measurement stability index calculation unit 14 then sets $I_{UB}$ to N−1 (step 1402). The index $I_{UB}$ is the position, on the list m( ), of the m/z value providing the upper limit of the determination range of the right-side half width at half maximum with respect to the peak of interest. Thereafter, the measurement stability index calculation unit 14 determines whether there is another peak on the higher-mass side than the peak of interest (step 1403). If an affirmative result is obtained, the measurement stability index calculation unit 14 proceeds to step 1404. If a negative result is obtained, the measurement stability index calculation unit 14 proceeds to step 1405.

In step 1404 (when there is another peak on the higher-mass side than the peak of interest), the measurement stability index calculation unit 14 sets, as the index $I_{UB}$ value, an index of the other peak positioned on the higher-mass side than the peak of interest. The index of the other peak provides the determination range upper limit.

In step 1405, the measurement stability index calculation unit 14 sets the right-side half width at half maximum $W_R$ to −1. This step is performed so that, when the right-side half-value width $W_R$ cannot be calculated with respect to the peak of interest, a determination to that effect can be made in a subsequent step. Thus, an invalid value that is not adoptable as the half width at half maximum is set.

The measurement stability index calculation unit 14 then sets an index i providing the readout position of the list m( ) to a value "$I_{mp}+1$" greater than the index $I_{mp}$ corresponding to the peak of interest by one. Thereafter, the measurement stability index calculation unit 14 determines whether the index i is equal to or smaller than an index $I_{UB}$ providing a determination range upper limit (step 1407). Here, a negative result means that the index i has exceeded the determination range. Thus, when a negative result is obtained in step 1407, the right-side half width at half maximum calculation process (step 1203) is terminated at this point in time.

On the other hand, if an affirmative result is obtained in step 1407, the measurement stability index calculation unit 14 determines whether the intensity s(i) with respect to the index i is equal to or smaller than the half value s/2 of the intensity of the peak of interest (step 1408). If the intensity s(i) is greater than the half value s/2, the measurement stability index calculation unit 14 obtains a negative result and proceeds to step 1409. In step 1409, the measurement stability index calculation unit 14 further modifies the index i to a value greater by one (step 1409). After the index i is updated, the measurement stability index calculation unit 14 returns to step 1407, and repeats the above-described determination process. If the intensity s(i) has reached the half value s/2 of the intensity of the peak of interest before the index i reaches the determination range upper limit, the measurement stability index calculation unit 14 obtains an affirmative result in step 1408 and proceeds to step 1410.

In step 1410, the measurement stability index calculation unit 14 calculates the right-side half width at half maximum $W_R$ of the peak of interest as a differential between the m/z value $m_p$ of the peak of interest and the m/z value m(i) corresponding to the index i.

Figure 15:
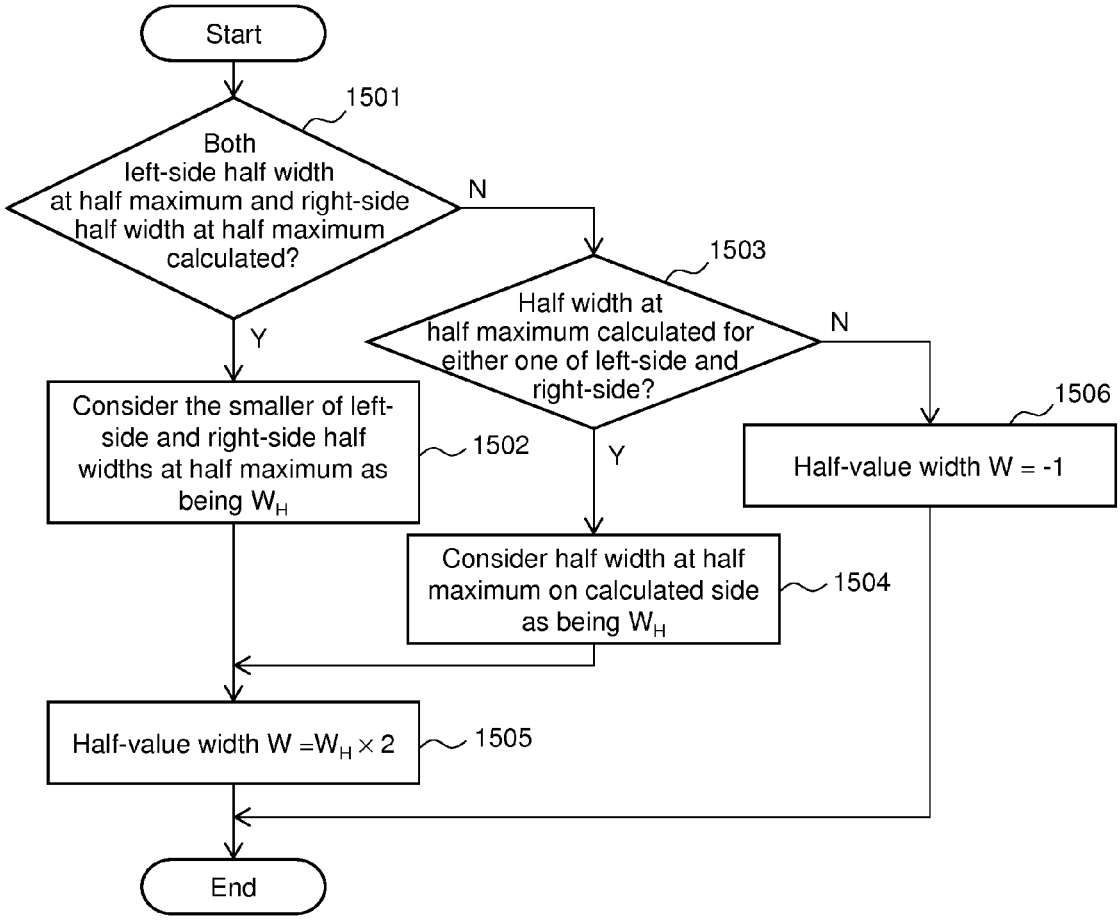
FIG. 15 is a chart for describing a half-value width calculation process based on a left-side calculation result and a right-side calculation result.

FIG. 15 shows the details of the calculation process (i.e., a half-value width calculation process) executed in step 1204. First, the measurement stability index calculation unit 14 determines whether both the left-side half width at half maximum $W_L$ and the right-side half width at half maximum $W_R$ have been calculated (step 1501). If an affirmative result is obtained, the measurement stability index calculation unit 14 sets the smaller of the half width at half maximum values to $W_H$ (step 1502).

On the other hand, if a negative result is obtained in step 1501, the measurement stability index calculation unit 14 determines whether one of the left-side half width at half maximum $W_L$ and the right-side half width at half maximum $W_R$ has been calculated (step 1503). If an affirmative result is obtained, the measurement stability index calculation unit 14 sets the half width at half maximum value that has been calculated as $W_H$ (step 1504).

After step 1502 or step 1504, the measurement stability index calculation unit 14 calculates the half-value width Was being twice the half width at half maximum $W_H$ (step 1505). If a negative result is obtained in step 1503 too, the measurement stability index calculation unit 14 sets "−1" to the half-value width W (step 1506). When the half-value width is "−1", this means that the half-value width cannot be calculated for the peak of interest. In this case, the half-value width W calculation process is continued for the peak with the next-highest intensity, as shown in step 908 of FIG. 9.

By using the above-described half-value width calculation method, the half-value width can be calculated even when the m/z value providing the peak intensity half value cannot be detected on both sides of the peak of interest. Further, even when the shape of the peak of interest is left-right asymmetric, the half-value width W can be calculated according to the above-described calculation method by using the half width at half maximum that has been calculated or the smaller half width at half maximum.

As the half-value width calculation method, methods other than those shown in FIG. 13 and FIG. 14 may be considered. For example, a normal distribution approximating the peak shape may be estimated by fitting using the least-square method and the like, and then the half-value width may be calculated using the standard deviation σ of the normal distribution. The half-value width calculation method using the standard deviation σ is indicated by expression 2.

$$\text{Half-value width} = 2 \times \sigma \times \sqrt{(2 \log 2)} \quad \text{(Expression 2)}$$

The calculation method using the normal distribution may be executed for each of the low-mass side and high-mass side of the peak, as in the case of FIG. 12. Using the above method or the like, the measurement stability index calculation unit 14 calculates the total amount of ion TIC and the half-value width W as indexes relating to measurement stability.

(Reason for Using Half-Value Width as Measurement Stability Index)

Figure 16:
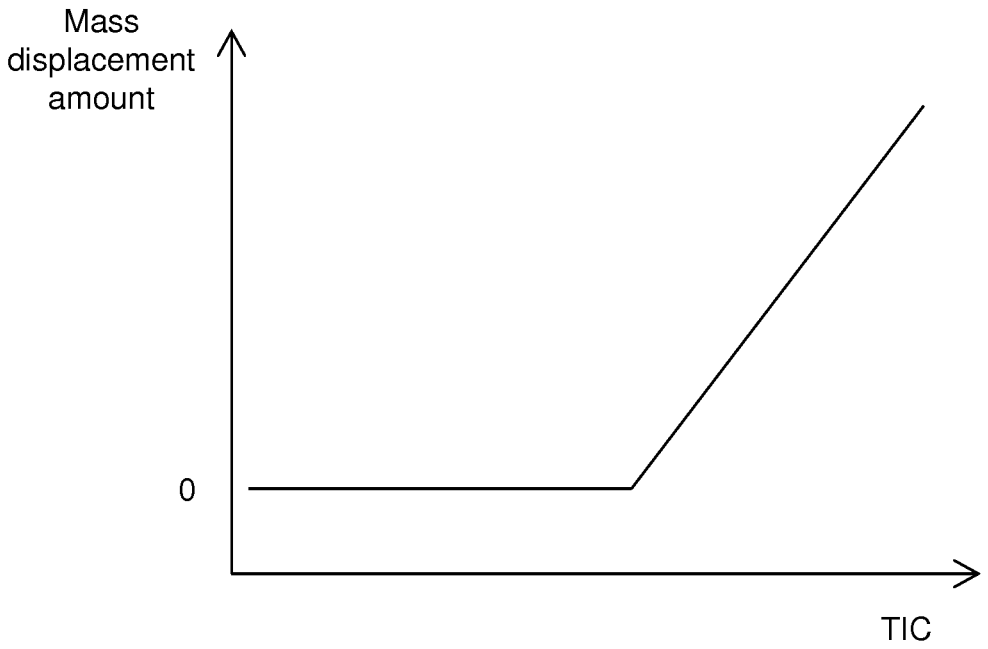
FIG. 16 is a chart for describing the relationship between TIC and mass displacement amount according to conventional art.

As described above, TIC represents the observed amount of ion. Thus, when the ion trapped in the ion trap and the observed ion substantially correspond to each other, it can be considered that TIC represents the status within the ion trap. In this case, as the space charge effect is caused as TIC increases, the amount of displacement of the mass spectrum also increases. Conventional art focuses on this characteristic. Namely, it is assumed that, as shown in FIG. 16, while there is no mass displacement when TIC is in a range not greater than a threshold value, the mass displacement amount increases in proportion to the increase in TIC when TIC is above the threshold value.

Figure 17:
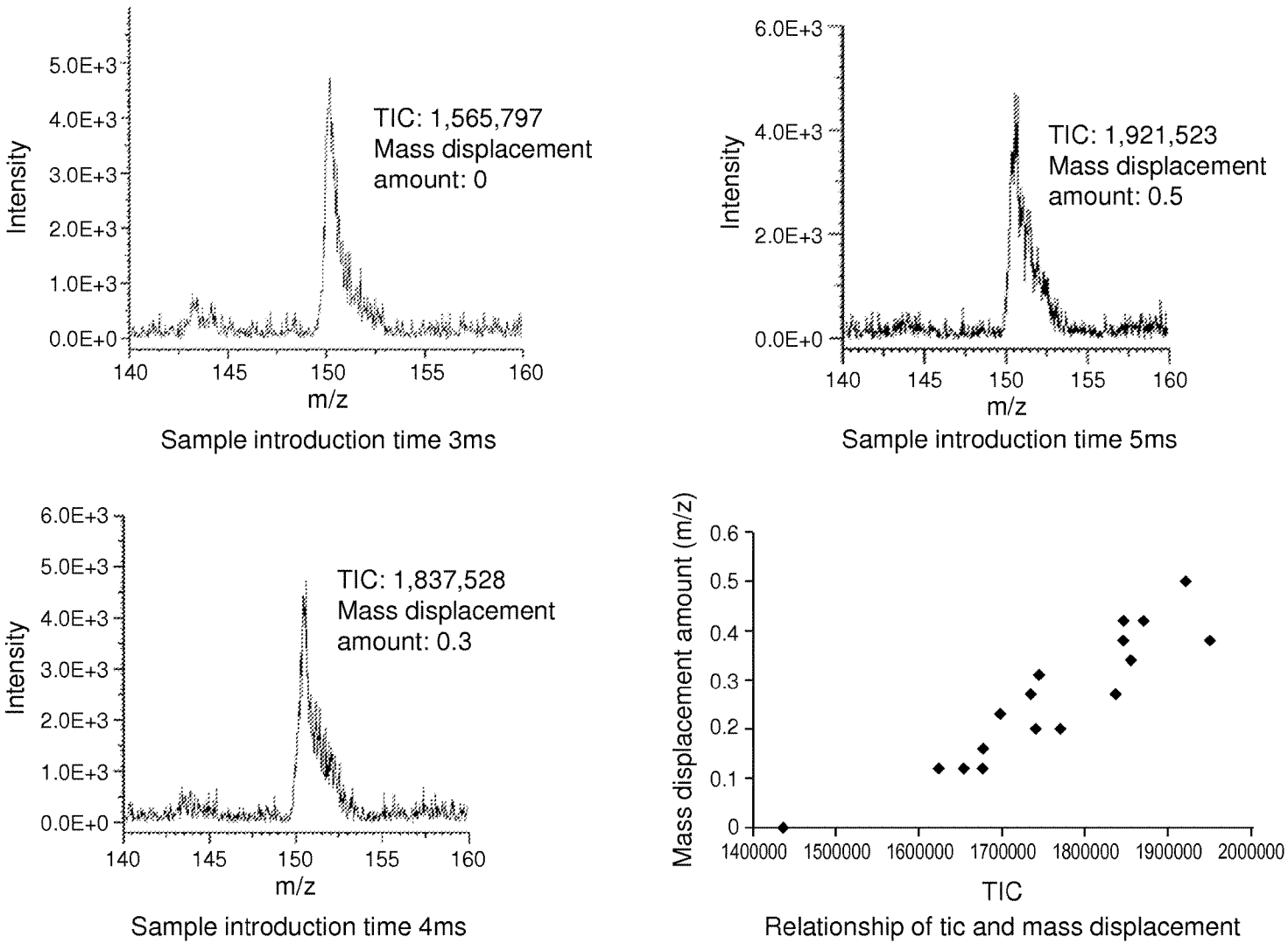
FIG. 17 is a chart for describing the relationship between an increase in TIC and mass displacement.

FIG. 17 shows examples of experiment data obtained by measuring methamphetamine (CAS No. 537-46-2, m/z 150.2) while the sample introduction time was varied in an intermittently introduced type atmospheric pressure barrier discharge ion source. In the figure, the upper-left graph is in the case of the sample introduction time of 3 ms; the lower-left graph is the case of the sample introduction time of 4 ms; and the upper-right graph is the case of the sample introduction time of 5 ms. As will be seen from the lower-right graph, the mass displacement amount is increased together with an increase in TIC accompanying an increase in sample introduction time.

Figure 18:
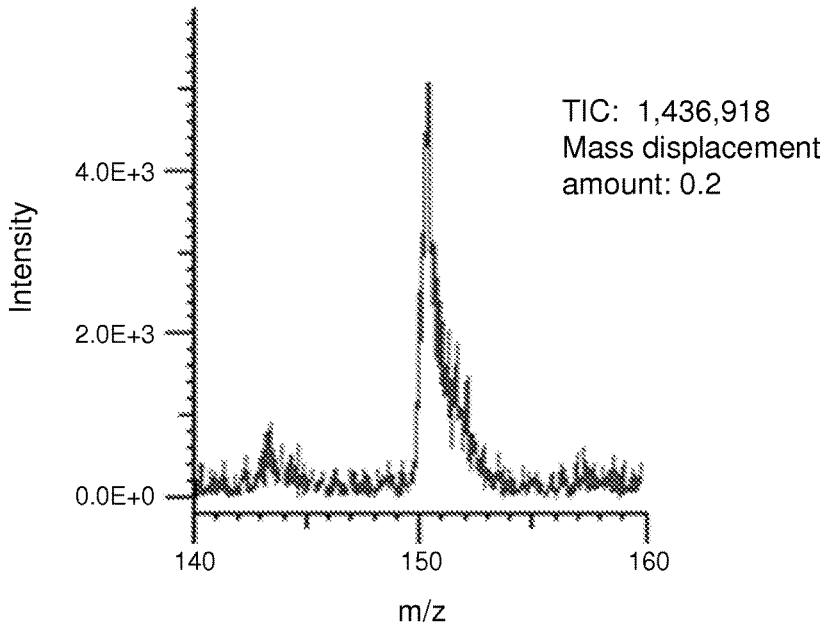
FIG. 18 illustrates an example in which mass displacement by the space charge effect is caused despite the TIC value is low.

However, as confirmed by the inventors, it has been learned that mass displacement may occur even in a TIC range where no mass displacement is supposed to occur. FIG. 18 illustrates an example. FIG. 18 shows the result of measurement of a urine sample to which methamphetamine had been added. In FIG. 18, the measured TIC is 1,436,918, which is smaller than in the case of the upper-left graph in FIG. 17. Thus, the mass displacement amount should normally be zero. However, in the graph of FIG. 18, a mass displacement amount of 0.2 is recognized, which corresponds to TIC of approximately 1,700,000.

One of the reasons for such exception is believed to involve the presence of ions having m/z values outside the measurement range in the ion trap, causing the space charge effect. This means that the influence of the space charge effect cannot be accurately calculated on the basis of only the TIC representing the ion status in the measurement range. However, even if the space charge effect could be evaluated using other information, TIC is still necessary for determining a status adversely affecting the measurement.

Figure 19:
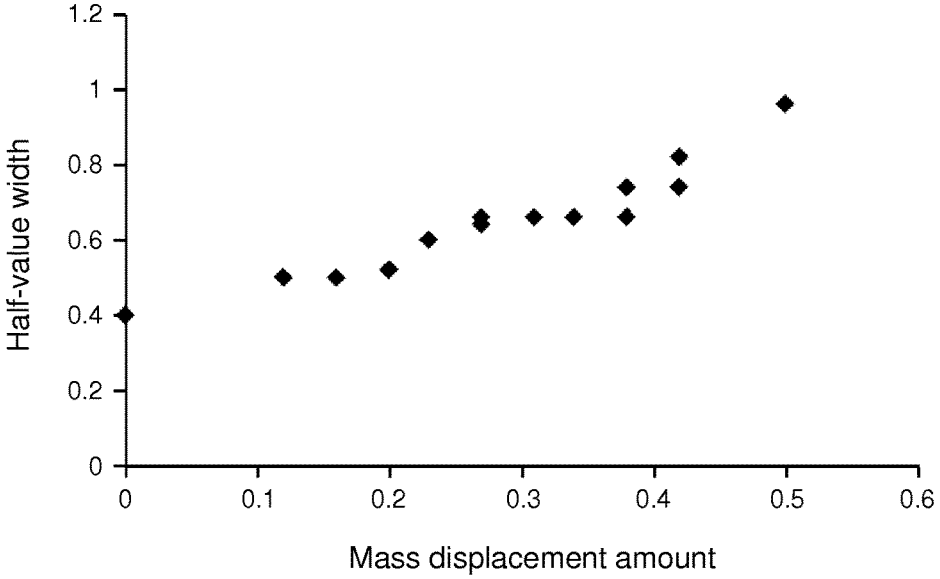
FIG. 19 is a chart for describing the relationship between the half-value width and mass displacement.

FIG. 19 is a graph indicating the relationship between the mass displacement in FIG. 17 and the half-value width W of each peak. As will be seen from this graph, when the half-value width W is known, the corresponding mass displacement amount can be estimated. Specifically, when the relationship between the mass displacement amount and the half-value width W is grasped in advance, the mass displacement amount can be estimated from the half-value width of the peak of interest.

Figure 20:
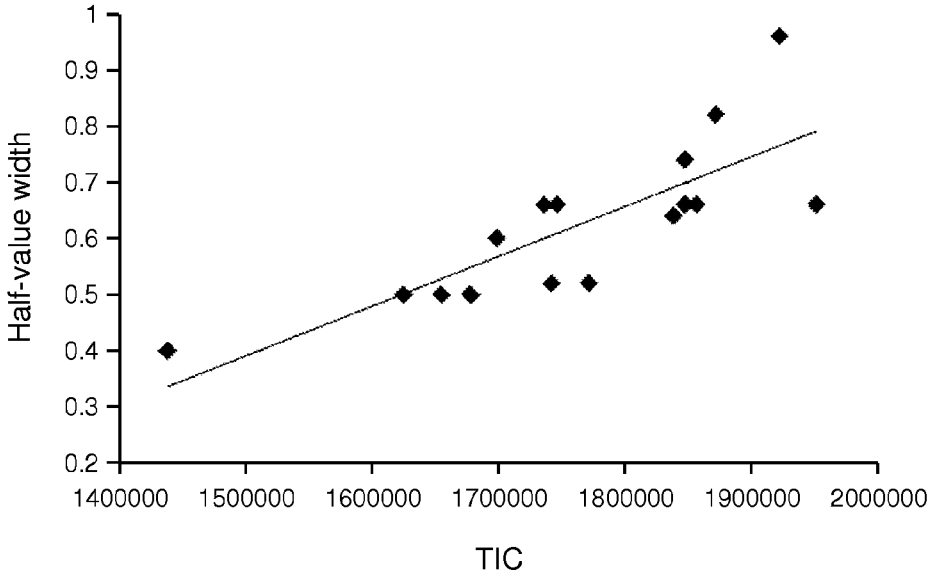
FIG. 20 is a chart for describing the relationship between TIC and half-value width.

FIG. 20 is a graph corresponding to the graph of FIG. 17 showing the relationship between the half-value width and the mass displacement amount, where the mass displacement amount is replaced by TIC. Thus, when the relationship between the half-value width W and TIC is grasped in advance, the relationship between the half-value width W and TIC in normal state can also be known. FIG. 20 also shows an approximation straight line. From the approximation straight line, it can be known that the relationship is such that the half-value width monotonously increases in accordance with TIC.

Figure 21:
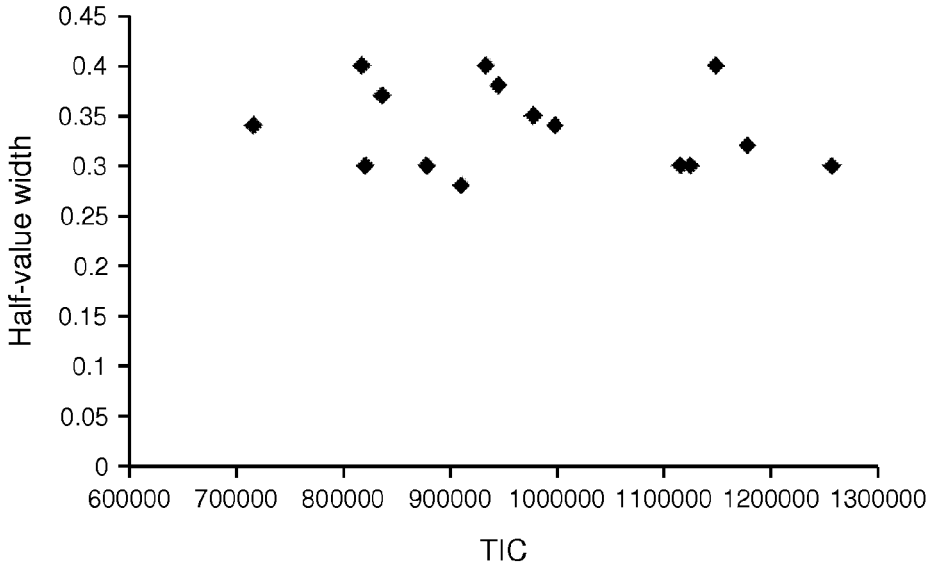
FIG. 21 is a chart for describing the relationship between TIC and half-value width in a state in which there is no influence of the space charge effect.
Figure 22:
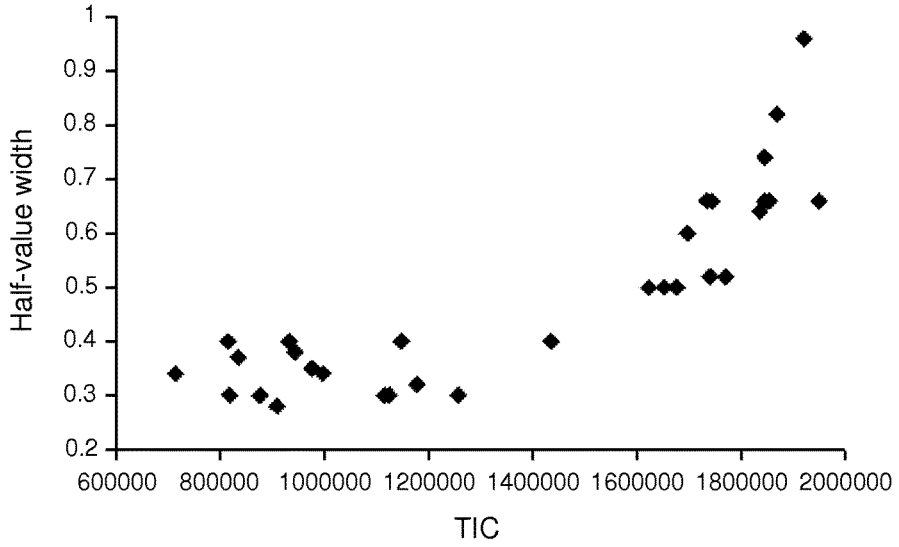
FIG. 22 illustrates the relationship between TIC and half-value width integrally in a state in which there is the space charge effect and a state where there is no space charge effect.

FIG. 21 is a graph showing the relationship between the relationship between TIC and the half-value width with regard to the result of measurement of methyl salicylate (CAS No. 119-36-8, m/z 153.2) in a state without mass displacement due to the space charge effect. FIG. 22 is a graph integrating the graph of FIG. 20 with the graph of FIG. 21. With reference to FIG. 22, it is seen that, in the mass spectrometer used for measurement, no increase is caused in the half-value width W due to an increase in TIC and no problem is caused in the measurement state when the half-value width is not greater than 0.4 and TIC is not greater than 1,400,000 to 1,500,000.

These threshold values derive from a physical phenomenon in the ion trap, and are not related to the type of the connected ion source. Thus, a threshold value can be determined and set through a prior experiment once the ion trap is mounted to the mass spectrometer device.

By using the graph of FIG. 22, an upper limit value of TIC such that the space charge effect is not caused can be automatically calculated by the following procedure. First, the data processing unit 4 in a first step determines the approximation straight line with respect to the portion corresponding to FIG. 20 (the portion with the influence of the space charge effect), and determines the upper limit value of the half-value width W with respect to the portion corresponding to FIG. 21 (the portion without the influence of the space charge effect). Then, the data processing unit 4, in a second step, sets the TIC at the point of intersection of the approximation straight line and the upper limit value as the upper limit value of TIC such that the space charge effect is not caused. In the case of this example, it can be read that the threshold value of the half-value width is 0.4, and the threshold value of TIC is approximately 1,500,000. The respective threshold values may be set by the user through a similar procedure.

Further, by using a substance with a known mass, the half-value width and the TIC upper limit value in the state without the space charge effect can be automatically set by the following procedure. First, the data processing unit 4 automatically acquires mass spectrum data in a "state without the space charge effect" and a "state with the space charge effect", and calculates the half-value width of each mass spectrum and TIC. Then, the data processing unit 4 automatically sets the half-value width W in the "state without the space charge effect" and the TIC upper limit value. By executing the automatic measurement operation before the actual measurement, displacement in the threshold values due to an ion trap state change caused by changes in the mass spectrometer device over time can be corrected. Obviously, the user may set the respective threshold values through a similar procedure.

Here, FIG. 18 will be considered, in which an exceptional measurement example was obtained. In the case of FIG. 18, the half-value width of the mass spectrum calculated by the measurement stability determination unit 6 is 0.52. The value 0.52 is greater than the half-value width threshold value 0.4. From this fact, it can be presumed that mass displacement will be caused. Further, from the relationship between the half-value width and TIC shown in FIG. 20, it is seen that the calculated TIC value "1,436,918" greatly deviates from the TIC value corresponding to the half-value width. Thus, by using the two measurement values of the half-value width W and TIC, the control instruction calculation unit 7 can automatically determine that ions outside the measurement range are present in the ion trap, causing the space charge effect.

In the ion trap, a process called isolation whereby unwanted ions are eliminated from within the ion trap can be performed. Thus, when a status such as the one in FIG. 18 is caused, the isolation operation may be performed outside the measurement range, whereby the state in the ion trap can be brought closer to normally state when measured. Low-mass side ions are in many cases naturally eliminated by the cut-off limit of the ion trap. Accordingly, by performing the isolation operation particularly for the high-mass side, the unwanted ions adversely affecting the measurement can be reduced. However, the isolation operation may also be performed for the low-mass side when it can be considered that ions outside the measurement range are present in the ion trap on the low-mass side too, such as when the ion scan range is narrower than the trap range.

(Determination of Measurement Method Using TIC and the Half-Value Width)

Figure 23:
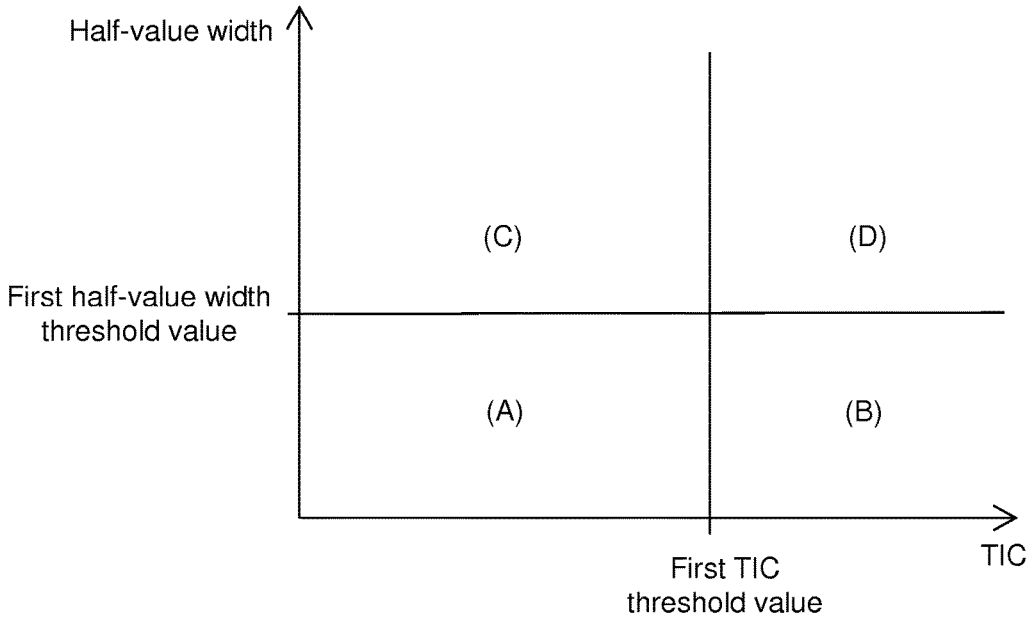
FIG. 23 illustrates an example of determining conditions used when measurement state stability is determined.

FIG. 23 illustrates the measurement state stability determining conditions. In FIG. 23, the horizontal axis shows TIC, and the vertical axis shows the half-value width. A first half-value width threshold value and a first TIC threshold value shown in FIG. 23 are TIC and half-value width upper limit values set using FIG. 22 such that no mass displacement due to the space charge effect is caused. In the case of the example of FIG. 23, the first TIC threshold value is 1,500,000, and the first half-value width threshold value is 0.4.

By the two threshold values, the space providing the relationship between TIC and the half-value width is divided into four regions.

A region (A) is a space in which both TIC and the half-value width are in a proper range. When the measurement result belongs to this region, the control instruction calculation unit 7 performs no measurement environment modification.

A region (B) is the case where, while the half-value width is not greater than the first half-value width threshold value, TIC exceeds the first TIC threshold value. In the case where the measurement result belongs to this region, if stability is given emphasis, the control instruction calculation unit 7 controls the next round of the measurement method so that the amount of ion in the ion trap can be reduced to approach the region (A). When the measurement result belongs to this region, if sensitivity is given emphasis, the control instruction calculation unit 7, determining that there is no adverse influence, such as mass displacement, implements control such that both TIC and the half-value width are within a proper range. Which control is to be implemented depends on the prior setting or user selection.

A region (C) is the case where, although TIC is not greater than the first TIC threshold value, the half-value width exceeds the first half-value width threshold value. When the measurement result belongs to this region, the control instruction calculation unit 7, determining that ions outside observation are present in the ion trap, for example, may implement control to selectively eliminate the ions outside observation. Alternatively, when the measurement result belongs to this region, the control instruction calculation unit 7 may select control to uniformly reduce the ions in the ion trap so as to decrease the adverse influence of the ions outside observation.

A region (D) is the case where both TIC and the half-value width exceed corresponding threshold values. For example, when continuation of measurement is given emphasis, the control instruction calculation unit 7, determining that the amount of ion is excessive, may implement control to reduce the amount of ion in the ion trap. On the other hand, when device soundness is given emphasis, the control instruction calculation unit 7 may stop the measurement operation in consideration of the influence of device contamination.

As described above, in the measurement stability determination unit 15 according to the present embodiment, the measurement state stability of each round of measurement is determined on the basis of TIC, the half-value width, and the reference for determination shown in FIG. 23. Also, the control instruction calculation unit 7 controls the introduction or elimination of ions or the device operation state in accordance with the result of determination. Thus, the mass spectrometer device 1 according to the present embodiment makes it possible to reduce excessive ions, eliminate adversely affecting ions, and automatically ensure device soundness.

Figure 24:
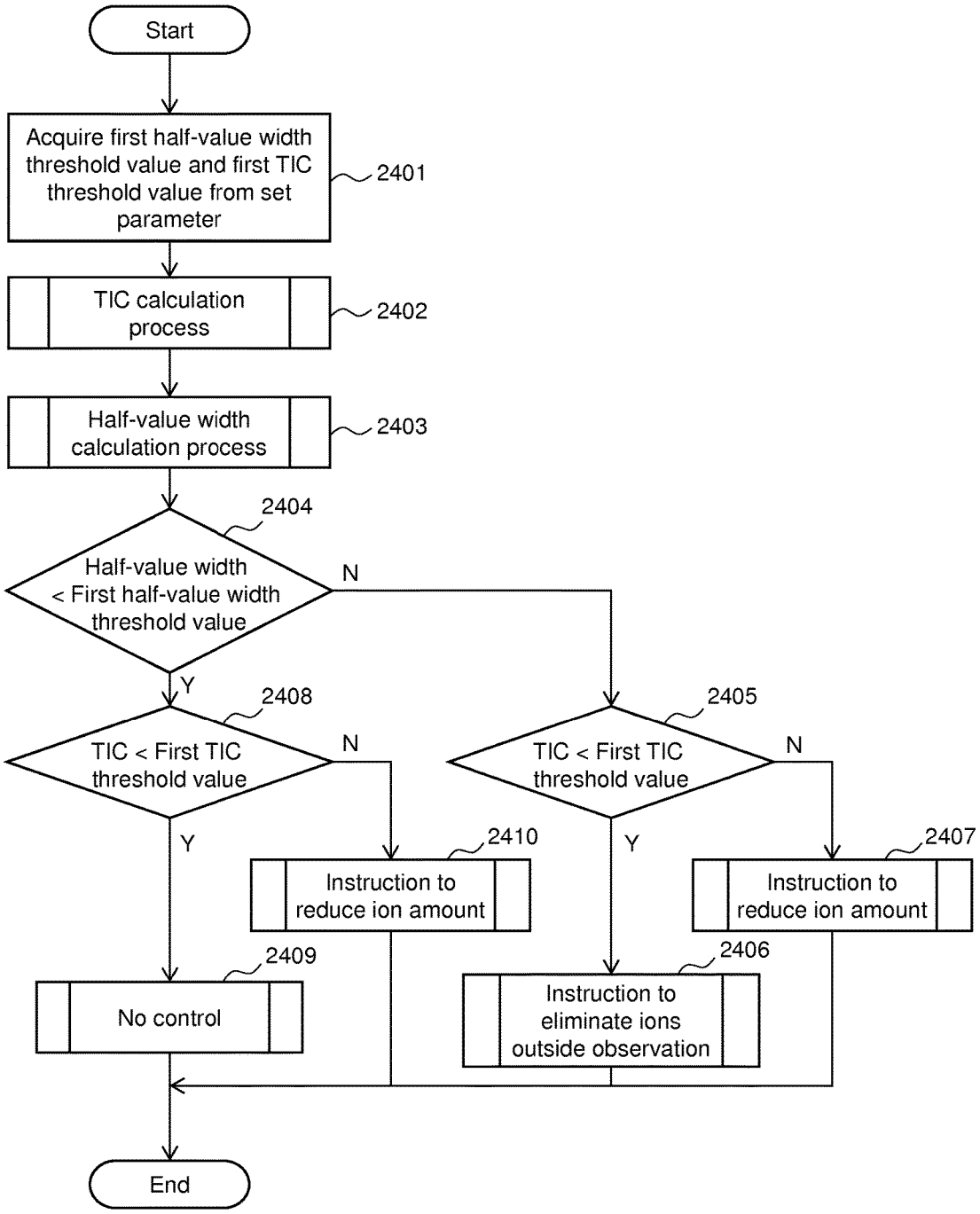
FIG. 24 illustrates a process procedure used when measurement state stability is determined.

FIG. 24 shows the details of the process operation executed by the measurement stability determination unit 15 and the control instruction calculation unit 7. FIG. 24 shows the case in which, as the process for the regions (B) and (D), the ion amount reduction process is selected.

First, the measurement stability determination unit 15 acquires the first half-value width threshold value and the first TIC threshold value from the set parameters (step 2401). Then, on the basis of the measurement data, the measurement stability determination unit 15 executes a TIC calculation process (step 2402) and a half-value width calculation process (step 2403). When the respective values have been calculated, the measurement stability determination unit 15 determines whether the half-value width calculated from the measurement data is smaller than the first half-value width threshold value (step 2404). If a negative result is obtained, the measurement stability determination unit 15 proceeds to step 2405. If an affirmative result is obtained, the measurement stability determination unit 15 proceeds to step 2408.

Both in step 2405 and step 2408, the measurement stability determination unit 15 determines whether the calculated TIC is smaller than the first TIC threshold value. If an affirmative result is obtained in step 2405 (in the case of region (C)), the control instruction calculation unit 7 issues an instruction for removal of ions outside observation (step 2406). On the other hand, if a negative result is obtained in step 2405 (in the case of region (D)), the control instruction calculation unit 7 issues an instruction for reducing the amount of ion (step 2407). If an affirmative result is obtained in step 2408 (in the case of region (A)), the control instruction calculation unit 7 does not perform any modification control (step 2409). On the other hand, if a negative result is obtained in step 2408 (in the case of region (B)), the control instruction calculation unit 7 issues an instruction for reducing the amount of ion (step 2410).

Conclusion

Thus, by using the mass spectrometer device 1 according to the present embodiment, it becomes possible to automatically and accurately determine the measurement state stability regardless of the type of ion source or ion trap, and to automatically determine the measurement method for use in the next round of measurement. Further, by the determination technique according to the present embodiment, measurement stability of the mass spectrometer device using an ion trap can be systematically handled. For example, it becomes possible to determine whether ionization is stable, whether the amount of ion is excessive, whether there is obstruction to measurement due to ions outside the measurement range, whether there is the space charge effect, whether the space charge effect can be corrected, and so on. In addition, by the determination technique according to the present embodiment, individual status can be determined, so that the measurement by the mass spectrometer device can be stabilized by executing control in accordance with individual status.

The application of the mass spectrometer device 1 according to the present embodiment is not necessarily limited to a mass spectrometer device that can be carried to a location other than the laboratory. The mass spectrometer device 1 may be mounted in a device used in an experiment device, whereby an increase in accuracy and a decrease in the burden on the user can be effectively achieved. It is noted, however, that when applied to the mass spectrometer device 1 used outside the laboratory environment, mass analysis can be stably implemented even in an investigation site environment with variable environmental conditions or measurement conditions such as sample concentration.

Second Embodiment

In the case of the first embodiment, the case has been described in which the next measurement method is controlled by using, as the threshold values, the half-value width and TIC upper limit values such that mass displacement due to the space charge effect is not caused. However, there may be cases where priority is to be given to sensitivity even while permitting a certain degree of mass displacement.

Thus, according to the present embodiment, a measurement method determination method in a case where a certain degree of mass displacement can be permitted will be described.

Figure 25:
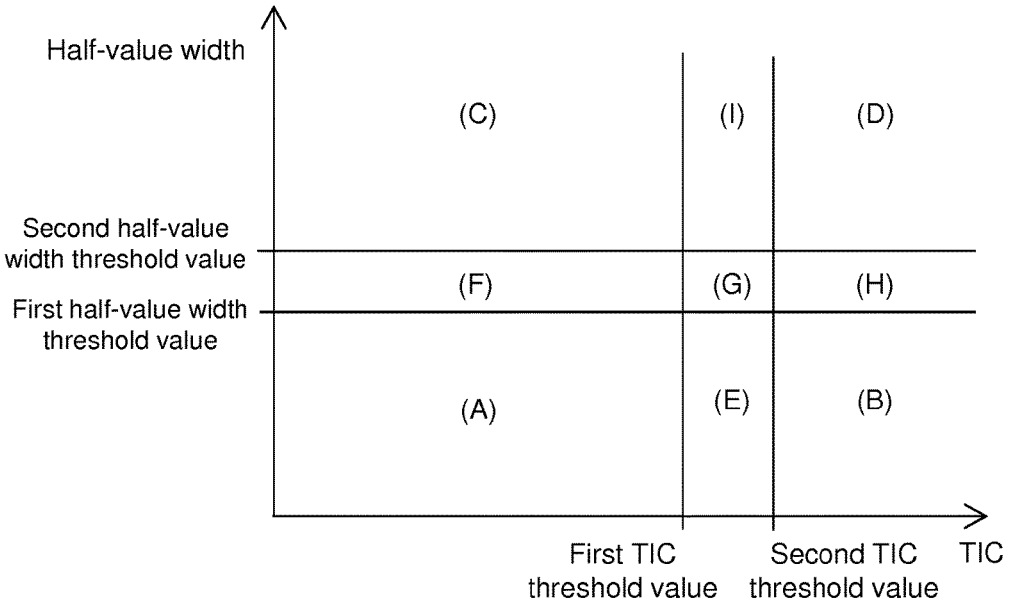
FIG. 25 illustrates another example of the determining conditions used when measurement state stability is determined.

FIG. 25 shows the measurement state stability determining conditions used in the present embodiment. In the present embodiment, in order to perform measurement with increased sensitivity even at the expense of mass accuracy, the error permitted in the mass number is 0.3, which is 0.6 in the half-value width threshold value from FIG. 19. In the case of FIG. 22, a second half-value width threshold value and a second TIC threshold value are respectively 0.6 and 1,700,000. The first half-value width threshold value and the first TIC threshold value are the same as those in the first embodiment. Namely, the first half-value width threshold value is 0.4, and the first TIC threshold value is 1,500,000.

In FIG. 25, by these four threshold values, the space providing the relationship between TIC and the half-value width is divided into nine regions.

In the case of the present embodiment, a region (A) is the case where the TIC measurement value is smaller than the first TIC threshold value, and the half-value width measurement value is smaller than the first half-value width threshold value. When the measurement result belongs to this region, the control instruction calculation unit 7 does not perform measurement environment modification. The control content is the same as in the first embodiment.

A region (B) is the case where the TIC measurement value is equal to or greater than the second TIC threshold value but the half-value width measurement value is smaller than the first half-value width threshold value. When the measurement result belongs to this region, if stability is given emphasis, the control instruction calculation unit 7 determines the next round of measurement method so that the amount of ion in the ion trap can be reduced to approach the region (A). When the measurement result belongs to this region, if sensitivity is given emphasis, the control instruction calculation unit 7 implements control to regard both TIC and the half-value width as being in a proper range.

A region (C) is the case where the TIC measurement value is smaller than the first TIC threshold value but the half-value width measurement value is equal to or greater than the second half-value width threshold value. When the measurement result belongs to this region, the control instruction calculation unit 7 implements control to selectively eliminate the ions outside observation, or select control to uniformly reduce the ions in the ion trap.

A region (D) is the case where the TIC measurement value is equal to or greater than the second TIC threshold value and the half-value width measurement value is equal to or greater than the second half-value width threshold value.

When the measurement result belongs to this region and continuation of measurement is given emphasis, the control instruction calculation unit 7 implements control to reduce the amount of ion in the ion trap. On the other hand, when the measurement result belongs to this region and device soundness is given emphasis, the control instruction calculation unit 7 issues instruction to stop the measurement operation in consideration of the influence of device contamination.

A region (E) is the case where the TIC measurement value is equal to or greater than the first TIC threshold value and smaller than the second TIC threshold value, and the half-value width measurement value is smaller than the first half-value width threshold value. A region (F) is the case where the TIC measurement value is smaller than the first TIC threshold value, and where the half-value width measurement value is equal to or greater than the first half-value width threshold value and smaller than the second half-value width threshold value. A region (G) is the case where the TIC measurement value is equal to or greater than the first TIC threshold value and smaller than the second TIC threshold value, and where the half-value width measurement value is equal to or greater than the first half-value width threshold value and smaller than the second half-value width threshold value. When the measurement result belongs to these regions, the control instruction calculation unit 7 implements the same control as in the case of the region (A).

A region (H) is the case where the TIC measurement value is equal to or greater than the second TIC threshold value but the half-value width measurement value is equal to or greater than the first half-value width threshold value and smaller than the second half-value width threshold value. When the measurement result belongs to these regions, the control instruction calculation unit 7 implements the same control as in the region (B). If a mass number correction process of one type of another can be performed, such process may be executed.

A region (I) is the case where the TIC measurement value is equal to or greater than the first TIC threshold value and smaller than the second TIC threshold value, and where the half-value width measurement value is equal to or greater than the second half-value width threshold value. When the measurement result belongs to these regions, the control instruction calculation unit 7 implements the same control as in the region (C).

By assigning the above control content to the respective regions, the measurement data can be effectively utilized under the condition of the allowable mass number error of 0.3.

Third Embodiment

In the present embodiment, a modification of the second embodiment will be described. In the case of the present embodiment, in FIG. 25, the control content of the region (B) is assigned to the region (E). To the region (F), the same control content as in the region (C) and a control content that outputs a mass displacement warning and information to the output spectrum are assigned. To the region (G), the same control content as in the region (D), and a control content that outputs a mass displacement warning and information to the output spectrum are assigned. To the region (H) and the region (I), the control content of the region (D) is assigned. If a mass number correction process of one type of another is possible instead of outputting the warning information, the process may be executed, or the mass number correction process may be executed simultaneously with the output of warning information.

By assigning the above control content to the respective regions, the measurement method can be determined in a direction of increasing measurement accuracy while the measurement data is effectively utilized under the condition of the allowable mass number error of 0.3.

Fourth Embodiment

Figure 26:
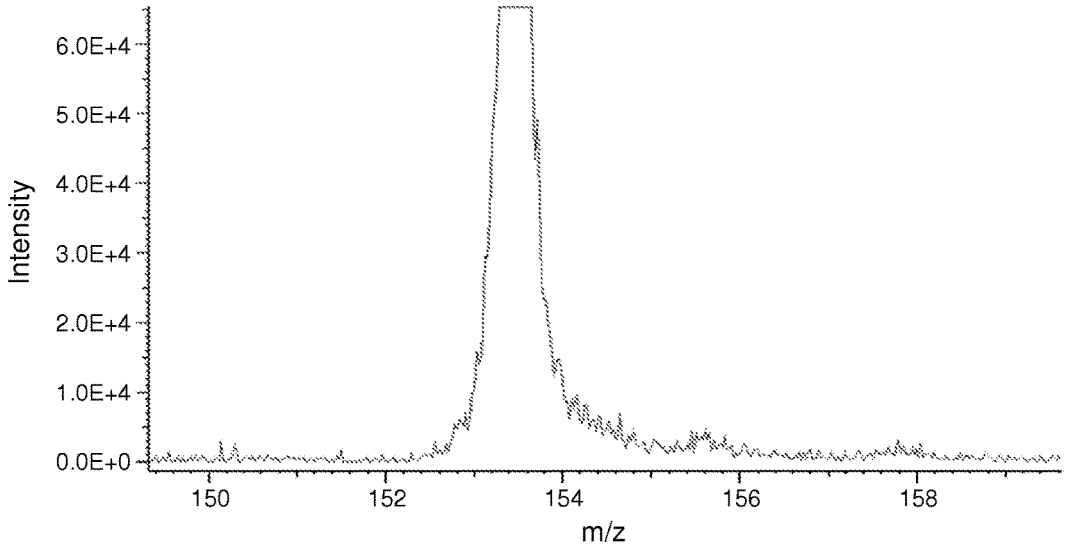
FIG. 26 illustrates an example in which the amount of ion with a certain m/z has reached an upper limit value of a detector.

In the present embodiment, a process function that can be preferably added to the mass spectrometer device according to the foregoing embodiments will be described. FIG. 26 shows an example in which the intensity of ions having a certain m/z value has reached the limit of the detector. Specifically, FIG. 26 shows an example in which, because the number of a certain ion that has been detected reached the upper limit of the number of ions that can be counted by the detector, the top of the peak waveform has hit the ceiling and become flat.

In the presence of such event, normal measurement cannot be performed. In order to perform normal measurement, the amount of ion in the ion trap needs to be decreased.

Thus, the mass spectrometer device according to the present embodiment is provided with a function such that, when the top of a certain peak has reached the limit of the numbers counted by the detector that is known at the time of designing the device, priority is given to control for decreasing the amount of ion over the determination process shown in FIG. 24. By adopting such control system, a mass spectrometer device capable of performing measurement with increased stability can be obtained.

Fifth Embodiment

Figure 27:
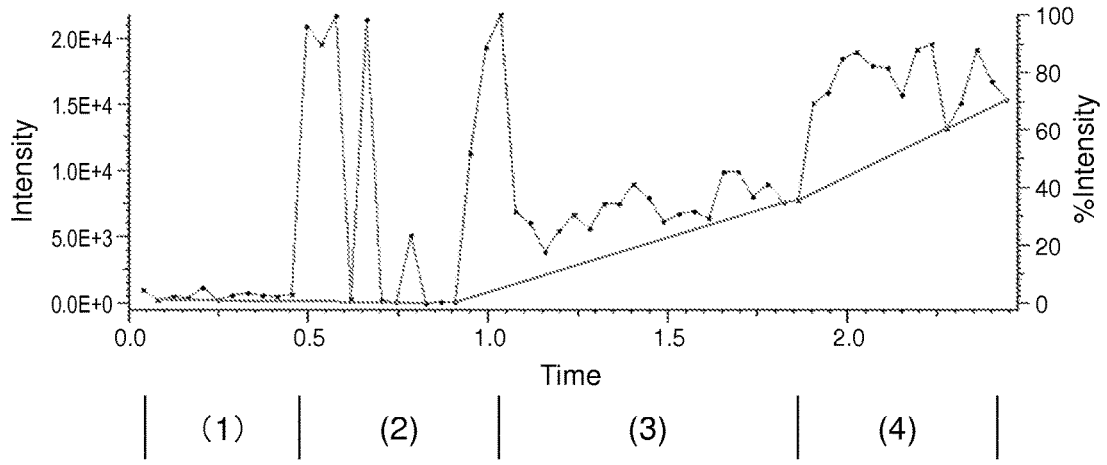
FIG. 27 illustrates an example in which ion source state stabilization is necessary.

Here, an ion source state stabilization function that may be preferably added to the mass spectrometer device according to the foregoing embodiments will be described. The necessity for the function will be described with reference to FIG. 27. FIG. 27 is a graph mapping, along a time axis, a plurality of TIC that was measured upon modification of the ion introduction time during a series of measurement periods in an intermittently introduced type of barrier discharge ion source. Each dot represents the TIC calculated in each round of measurement. In the sections designated with codes (1) to (4), sample measurement is performed using the same measurement parameters.

As will be seen from the change in the graph of FIG. 27, the ion source state is different in different sections. For example, in the time band of a section (1), a state where the amount of ion is small continues. Thus, in this time band, it is necessary to modify the measurement parameters for increasing the amount of ion. In the time band of a section (2), a sufficient amount of ion is observed. However, as in the case of the section (1), the state requiring an increase in the amount of ion appears irregularly, so that the status requires ion source stabilization. In the time band of a section (3), while the ion source is stable, the amount of ion is small, requiring measurement parameters modification for increasing the amount of ion. In the time band of a section (4), a sufficient amount of ion is observed, and the ion source is stable.

Figure 28:
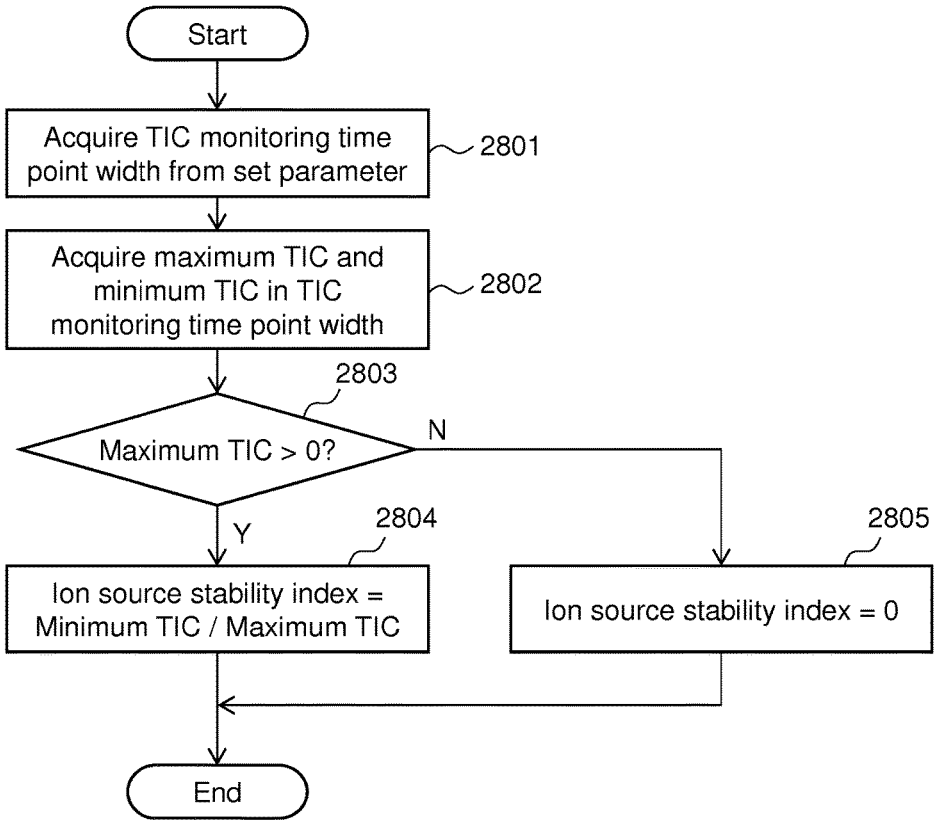
FIG. 28 is a chart for describing an ion source stability index calculation process.

FIG. 28 shows an index calculation process procedure for determining ion source stability. In the case of the present embodiment, the relevant function is executed by the measurement stability determination unit 15. The measurement stability determination unit 15 acquires a previously set time point width for TIC monitoring (step 2801). The time point width for TIC monitoring may be a fixed number of points in time, a fixed actual time width, or a section where the measurement parameters are the same.

Then, the measurement stability determination unit 15 acquires the maximum value and the minimum value of TIC in the range of the acquired time point width for TIC monitoring (step 2802). At this point in time, the measurement stability determination unit 15 determines whether the TIC maximum value is greater than zero (step 2803). If the TIC maximum value is greater than zero, the measurement stability determination unit 15 uses a value obtained by dividing the minimum value by the maximum value as an ion source stability index (step 2804). If the maximum value is zero, the measurement stability determination unit 15 sets the ion source stability index to zero (step 2805).

The ion source stability index takes a value of 0 to 1. It is considered that the closer the ion source stability index is to 1, the higher the stability, and that the closer the index is to 0, the smaller the stability. The index indicates a relative status of a certain measurement section, and may be applied regardless of the condition or dynamic range of the device.

When the index is calculated using a section with the same measurement parameters as the time point width for TIC monitoring, in the case of FIG. 27, the ion source stability index in the section (1) is 0.25; the ion source stability index in the section (2) is 0.01; the ion source stability index in the section (3) is 0.46; and the ion source stability index in the section (4) is 0.72. These numerical values correspond to visual stability determination.

Figure 29:
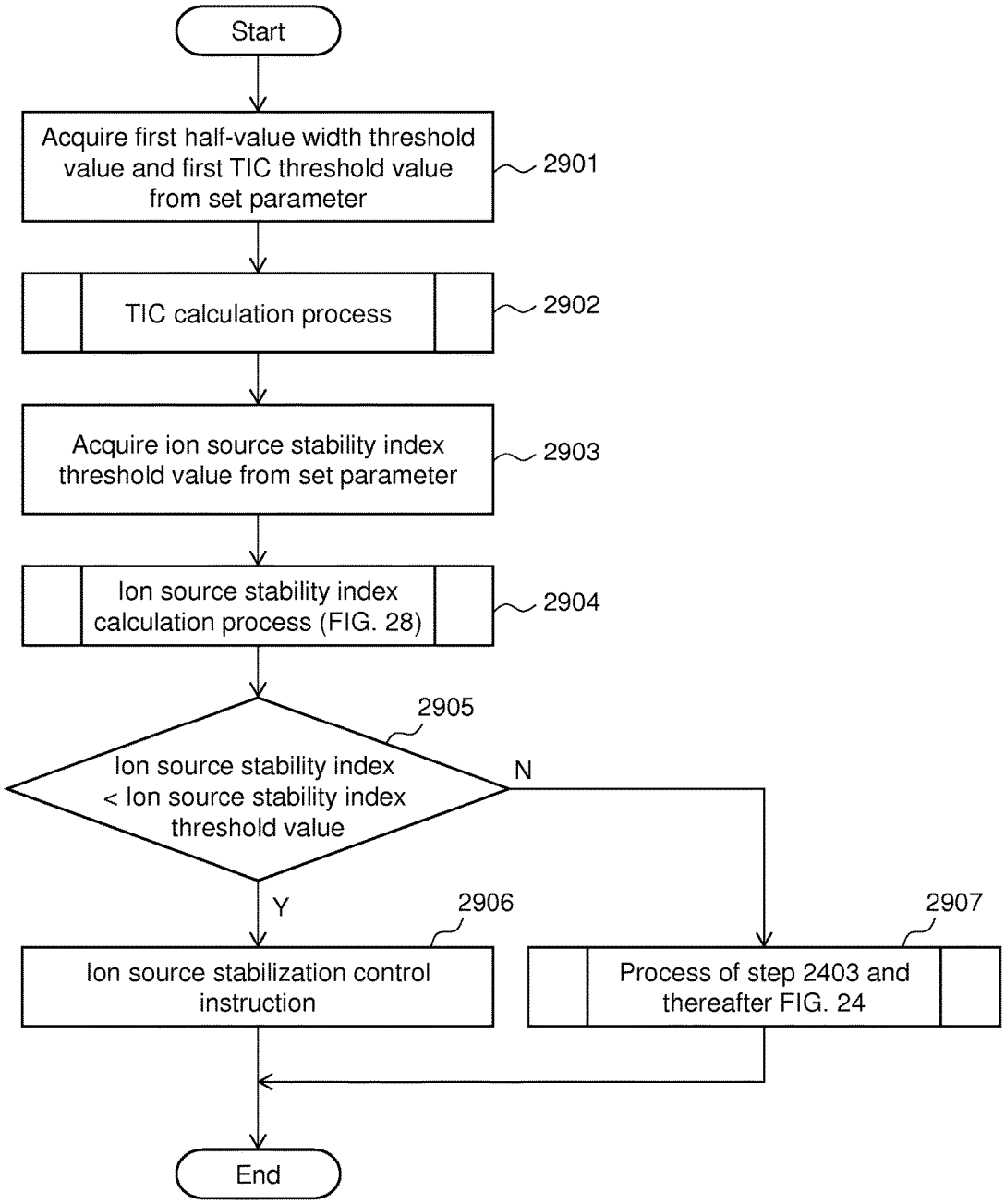
FIG. 29 illustrates a measurement state stability determination process procedure using an ion source stability index.

With reference to FIG. 29, the process function in which the above-described ion source state stabilization function is combined with the process function of the first embodiment (FIG. 24) will be described. The process operation shown in FIG. 29 is executed in the measurement stability determination unit 15 and the control instruction calculation unit 7.

First, the measurement stability determination unit 15 acquires the first half-value width threshold value and the first TIC threshold value from set parameters (step 2901). Then, on the basis of measurement data, the measurement stability determination unit 15 executes the TIC calculation process (step 2902). The measurement stability determination unit 15 then acquires an ion source stability index threshold value from the set parameters (step 2903).

Thereafter, the measurement stability determination unit 15 executes the process operation shown in FIG. 28, and calculates the ion source stability index (step 2904). At this stage, the measurement stability determination unit 15 determines whether the calculated ion source stability index is smaller than an ion source determining index threshold value (step 2905).

That the ion source determining index is smaller than the ion source determining index threshold value indicates that the ion source is unstable. Thus, if an affirmative result is obtained in step 2905, the control instruction calculation unit 7 issues an instruction for ion source stabilization control (step 2906). This is a state where, for example, the state of TIC being close to zero in the region (A) or (C) in FIG. 23 sometimes appears. In this case, the control instruction calculation unit 7 executes a control instruction giving priority to ion source stabilization without executing the control instructions in step 2403 and subsequent steps in FIG. 24.

On the other hand, if a negative result is obtained in step 2905 (when the ion source is stable), the measurement stability determination unit 15 continues to execute the process of step 2403 and subsequent steps in FIG. 24 (step 2907).

By using the mass spectrometer device according to the present embodiment, measurement can be executed in a state in which the ion source is stabilized and measurement stability is increased.

Sixth Embodiment

Figures 30, 31:
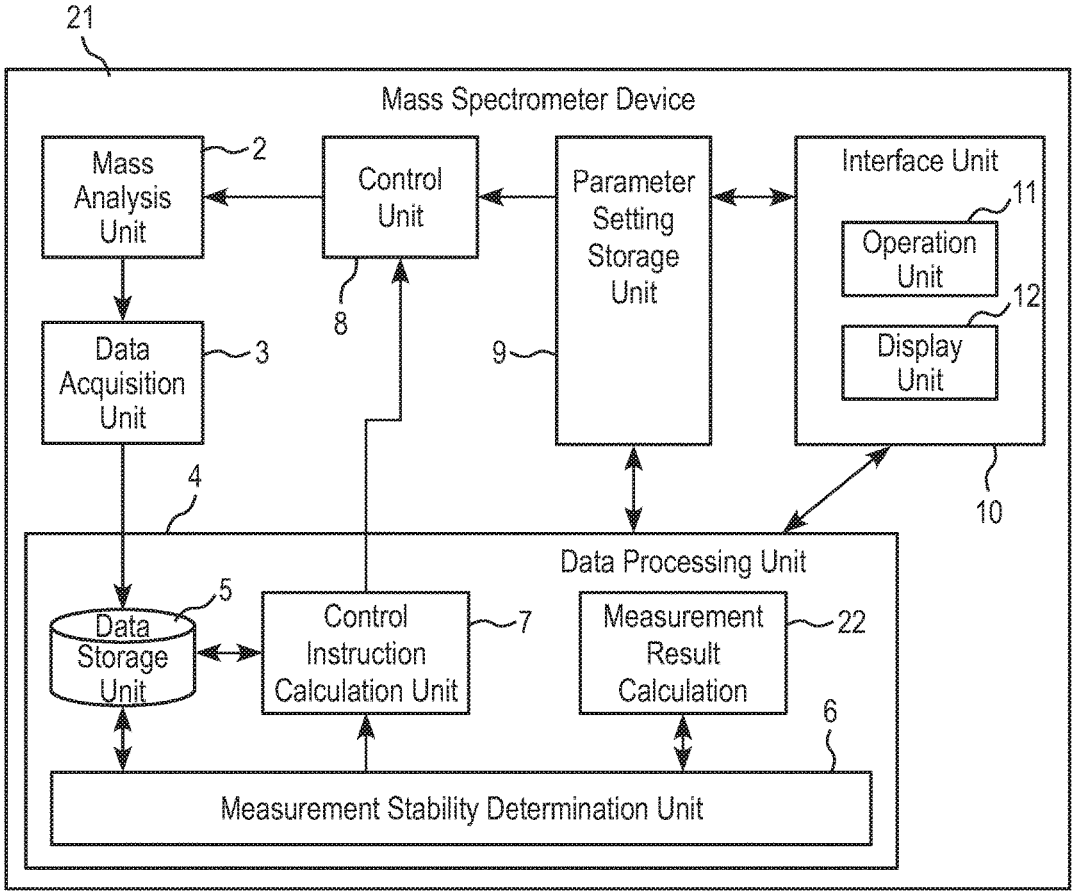
FIG. 30 illustrates a configuration of the mass spectrometer device according to a second embodiment.
FIG. 31 is a chart for describing an example of handling of data utilized for measurement result calculation.

FIG. 30 shows a device configuration example of a mass spectrometer device 21 according to the present embodiment. In FIG. 30, portions corresponding to those of FIG. 1 are designated with the corresponding signs. FIG. 30 differs from FIG. 1 in that a measurement result calculation unit 22 is added to the data processing unit 4. The measurement result calculation unit 22 is a process unit that executes a determining calculation corresponding to the purpose of application of the mass spectrometer device in accordance with the measurement result from the mass spectrometer device. For example, when the mass spectrometer device is applied in an illegal drugs detection device, the measurement result calculation unit 22 determines whether, on the basis of the measurement data (mass spectrum), illegal drugs are included in a sample.

If the measurement by the mass spectrometer device is unstable, the determining calculation may be influenced. For example, if mass displacement is included in the measurement data, or if the continuity between measurements is lost because of the unstable ion source, the reliability of the result of the determining calculation may be influenced.

Thus, the mass spectrometer device according to the present embodiment is provided with a function such that, when it is determined that the measurement is unstable, the measurement data is considered to be missing without handing the measurement data to the measurement result calculation unit 22 or such that the result of determining calculation is not output.

For example, when it is determined that the measurement is in unstable state, the mass spectrometer device according to the present embodiment invalidates the determining calculation going back to the TIC monitoring time width, without using the measurement data for the determining calculation. On the other hand, when it is determined that the measurement is in stable state, the mass spectrometer device according to the present embodiment uses all of the measured data. By this function, the accuracy of the result of determination can be increased.

FIG. 31 shows the rules of use of measurement data according to the present embodiment. In the case of the present embodiment, the determining calculation using measurement data is performed only when the measurement is stable and the ion source is stable. Even when the measurement is stable, if the ion source is unstable, the determining calculation is invalidated going back to the TIC range without performing the determining calculation. In the case where the measurement is unstable, the determining calculation is not performed regardless of the ion source state. The rules shown in FIG. 31 may be set for each content of the determining calculation. When the determining calculation is considered to be a part of the measuring function of the mass spectrometer device, the measurement stability can be increased by determining whether the measurement data is to be utilized for the determining calculation, as according to the present embodiment.

Seventh Embodiment

In the present embodiment, screen examples that may be preferably used for receiving the input of various parameters regarding the measurement stability index (hereafter referred to as "measurement stability determination parameters"), or process procedures and the like will be described.

Figure 32:
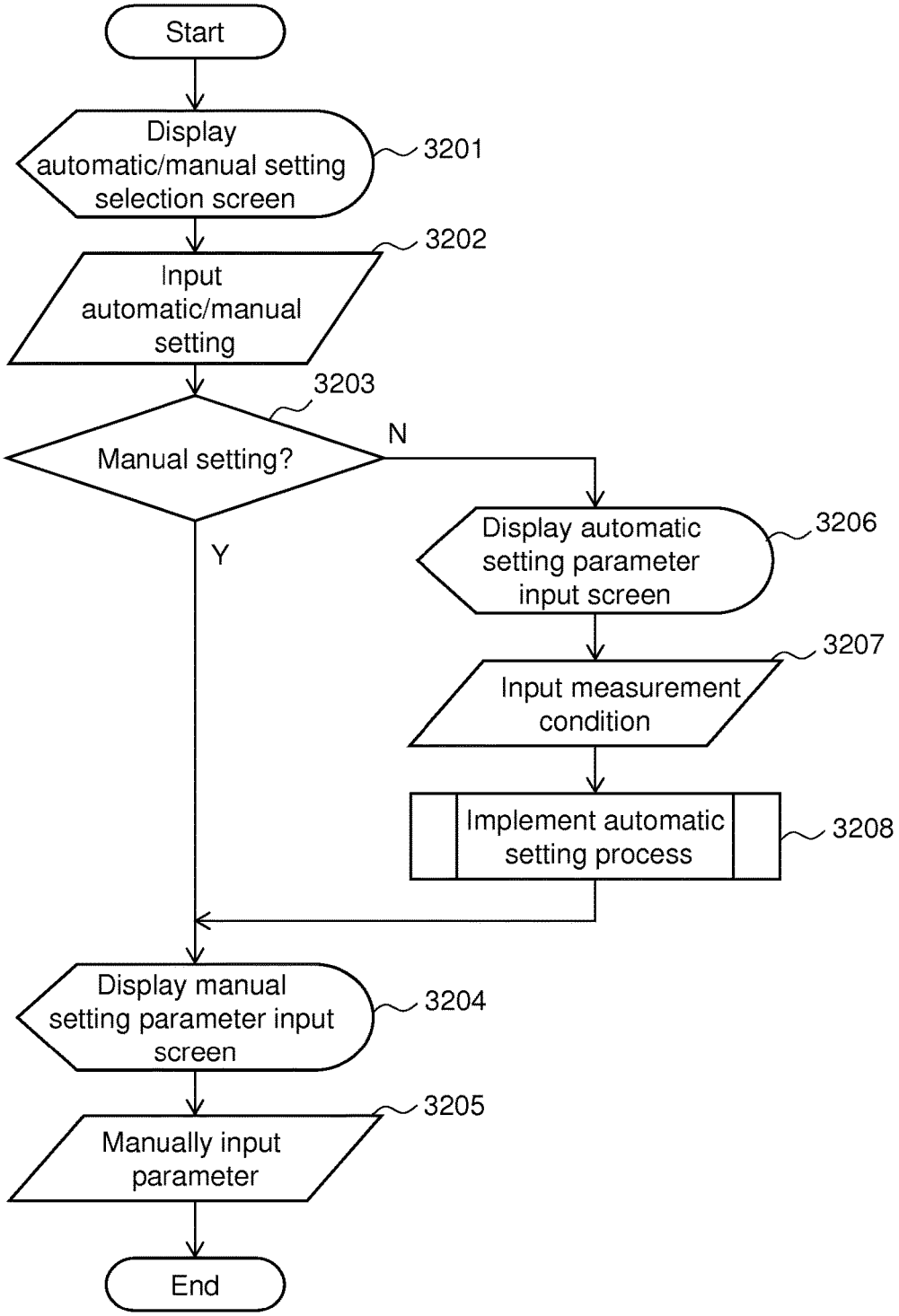
FIG. 32 is a chart for describing an input reception process for measurement stability determination parameters.

FIG. 32 shows an example of the input reception process procedure used when the measurement stability determination parameters are set in the mass spectrometer device according to the various embodiments.

When the measurement stability determination parameters are set, the mass spectrometer device displays a setting method selection screen 3301 (FIG. 33) on a screen (step 3201). In the selection screen 3301, there are displayed a button 3302 for selecting the measurement stability determination parameters setting method, an OK button 3303 for finalizing a selection, and a cancel button 3304 for invalidating the selection.

Figure 33:
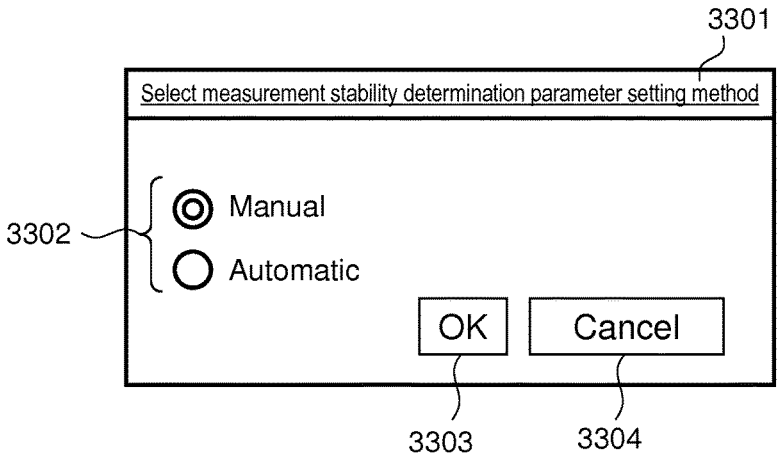
FIG. 33 is a chart for describing a screen for selecting a measurement stability determination parameters setting method.

The mass spectrometer device receives the selection input by the user via the selection screen 3301 (step 3202). FIG. 33 shows the state in which automatic setting of the measurement stability determination parameters is selected by the user.

Figure 34:
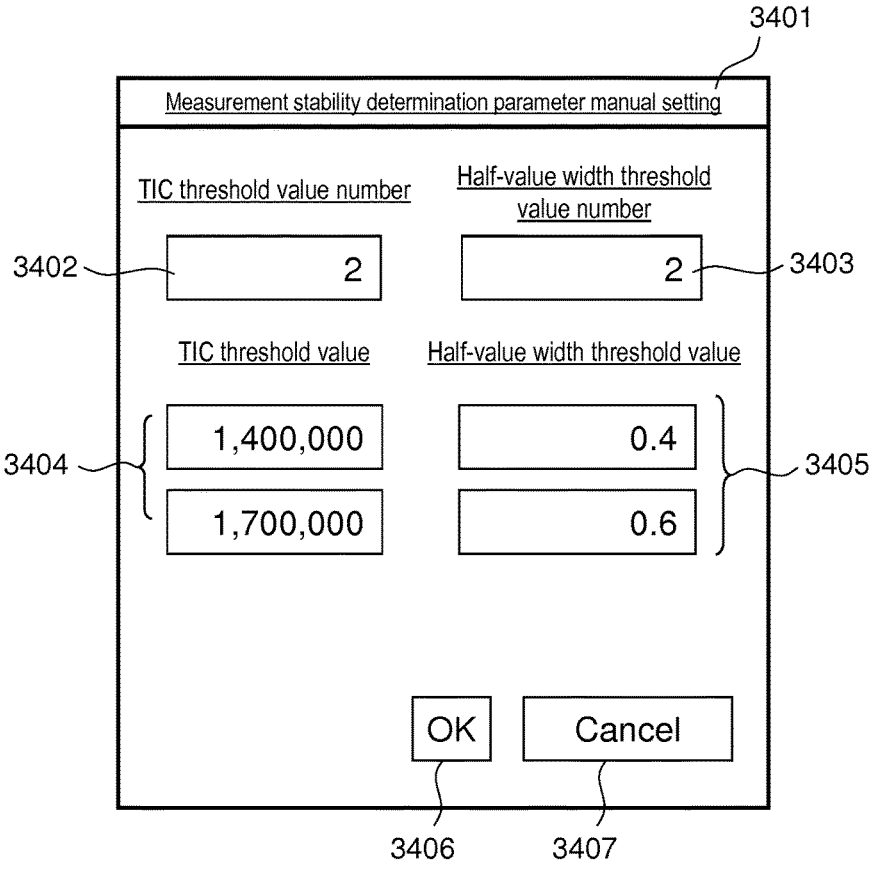
FIG. 34 is a chart for describing a screen for manually setting measurement stability determination parameters.

The mass spectrometer device then determines whether the selection by the user is "manual setting" (step 3203). If the user's selection is "manual setting", the mass spectrometer device displays a manual input screen 3401 shown in FIG. 34, for example (step 3204). On the screen 3401, there are displayed a TIC threshold value number input box 3402; a half-value width threshold value number input box 3403; an input box 3404 for a TIC threshold value corresponding to the input threshold value number; and a half-value width threshold value input box 3405. The user can freely input numerical values in the input boxes, using a mouse, a keyboard and the like. FIG. 34 shows the example in which the same numerical values as in the foregoing embodiments are input.

In the screen 3401, there are also prepared an OK button 3406 for finalizing an input, and a cancel button 3407 for invalidating the input. When the OK button 3406 is operated, the mass spectrometer device terminates the measurement stability determination parameters setting process (step 3205).

Figure 35:
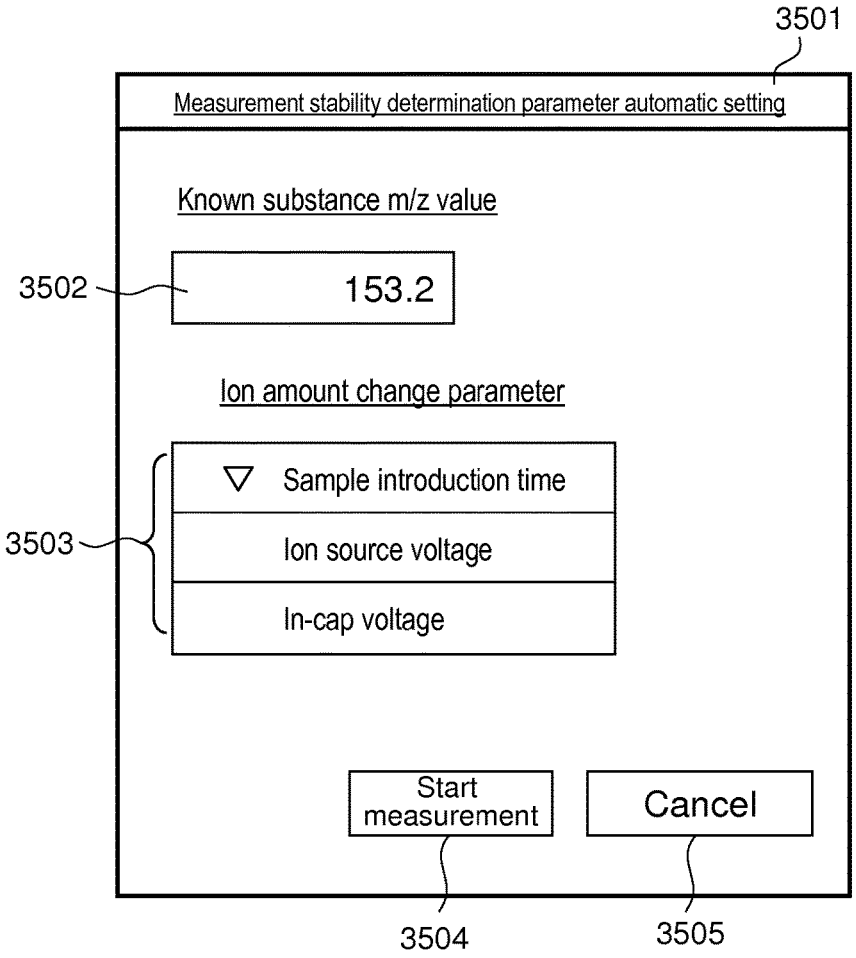
FIG. 35 is a chart for describing a screen for automatic setting of measurement stability determination parameters.

On the other hand, when the user's selection in the selection screen 3301 is "automatic setting", the mass spectrometer device displays an automatic setting screen 3501 (FIG. 35) on the screen (step 3206). The screen 3501 includes an input box 3502 for the m/z value of a known substance used for automatic setting, and an input box 3503 for selecting a parameter used for modifying the amount of ion. These input boxes are used for the input of measurement conditions (step 3207). For cancelling the inputs in the input boxes 3502 and 3503, a cancel button 3505 is used.

Figure 36:
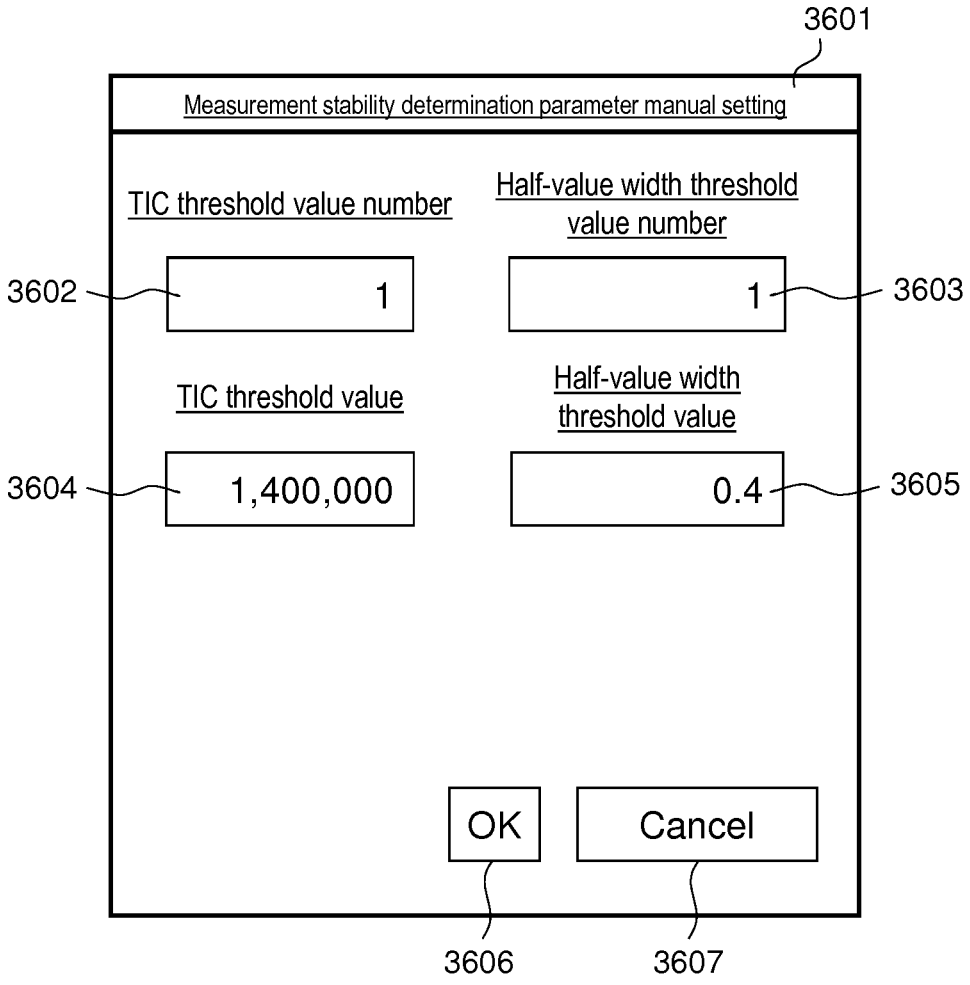
FIG. 36 is a chart for describing a manual setting screen after the execution of automatic setting of measurement stability determination parameters.

Upon detection of the operation of the measurement start button 3504, the mass spectrometer device starts measuring for automatic setting of the TIC threshold value and the half-value width threshold value (step 3208). Specifically, the mass spectrometer device automatically acquires measurement data indicating the relationship between TIC and the half-value width as shown in FIG. 22, and automatically calculates the threshold values shown in FIG. 23. The automatically set measurement stability determination parameters are turned over to a manual setting screen 3601 shown in FIG. 36. FIG. 36 shows an example in which no mass displacement is permitted. Thus, in a display box 3602 for the TIC threshold value number and a display box 3603 for the half-value width threshold value number, "1" is being displayed. In a display box 3604 for the TIC threshold value, "1,400,000" is being displayed. In a display box 3605 for the half-value width threshold value, "0.4" is being displayed as an initial value.

Because the screen 3601 is a manual setting screen, the user can manually adjust the displayed numerical values.

Other Embodiments

The present invention is not limited to the foregoing embodiments, and may include various modifications. The foregoing embodiments have been described in detail for the purpose of facilitating an understanding of the present invention, and are not limited to have all of the described elements. A part of one embodiment may be substituted by an element of another embodiment, or the element of the other embodiment may be added to an element of the one embodiment. With respect to some of the elements of each embodiment, addition of another element, deletion, or substitution may be made.

Some or all of the elements, functions, process units, process means and the like described above may be realized in the form of an integrated circuit or other hardware. The elements, functions and the like may be realized when a program for implementing the corresponding functions is interpreted and executed by a processor. Namely, the elements, functions and the like maybe realized in the form of software. The program for realizing the functions and information of tables, files and the like may be stored in a storage device, such as a memory, a hard disk, or a solid state drive (SSD), or in a storage medium, such as an IC card, an SD card, or a DVD.

The control lines and information lines indicate those considered necessary for description purpose and do not necessarily represent all of the control lines or information lines required in a product. In practice, it may be considered that almost all of the elements are mutually connected.

REFERENCE SIGNS LIST

1 Mass spectrometer device
2 Mass analysis unit
3 Data acquisition unit
4 Data processing unit
5 Data storage unit
6 Measurement stability determination unit
7 Control instruction calculation unit
8 Control unit
9 Parameter setting storage unit
10 Interface unit
11 Operation unit
12 Display unit
13 Spectrum preprocessing unit
14 Measurement stability index calculation unit
15 Measurement stability state determination unit
21 Mass spectrometer device
22 Measurement result calculation unit

The invention claimed is:

1. A mass spectrometer device comprising:

a first calculation unit that calculates a total amount of ion in a mass spectrum output from a mass analysis unit;

a second calculation unit that calculates a half-value width of a representative peak selected from peaks of the mass spectrum; and a control unit that determines a measurement method for use in a next round of measurement, on the basis of the total amount of ion and the half-value width of the representative peak;

wherein the second calculation unit calculates a half width at half maximum with respect to each of a low-mass side and a high-mass side of a top of the representative peak, and considers a value twice a value of the smaller of the half widths at half maximum to be the half-value width.

2. The mass spectrometer device according to claim 1, wherein the second calculation unit, when either the half width at half maximum on the low-mass side or the half width at half maximum on the high-mass side cannot be calculated, considers a value twice the value of the half width at half maximum that can be calculated to be the half-value width; and when the half width at half maximum cannot be calculated with respect to both the low-mass side and the high-mass side, the second calculation unit sets an invalid value for the half-value width.

3. The mass spectrometer device according to claim 2, wherein the second calculation unit calculates the half-value width by determining one of a plurality of peaks appearing in the mass spectrum that has the highest intensity as being the representative peak; and when the calculated half-value width is the invalid value, the second calculation unit calculates the half-value width by determining one of the plurality of peaks that has the next-highest intensity as being the representative peak.

4. The mass spectrometer device according to claim 1, wherein the first calculation unit calculates the total amount of ion as a sum of intensity values of the mass spectrum.

5. A mass spectrometer device comprising:

a first calculation unit that calculates a total amount of ion in a mass spectrum output from a mass analysis unit;

a second calculation unit that calculates a half-value width of a representative peak selected from peaks of the mass spectrum; and a control unit that determines a measurement method for use in a next round of measurement, on the basis of the total amount of ion and the half-value width of the representative peak;

wherein the control unit determines a state of the current round of measurement on the basis of a combination of a result of comparison of the total amount of ion measured with respect to the mass spectrum with one or a plurality of first threshold values, and a result of comparison of the half-value width of the representative peak measured with respect to the mass spectrum with one or a plurality of second threshold values.

6. The mass spectrometer device according to claim 5, wherein the control unit determines the measurement method for use in the next round of measurement on the basis of the state of the current round of measurement.

7. A mass spectrometer device comprising:

a first calculation unit that calculates a total amount of ion in a mass spectrum output from a mass analysis unit;

a second calculation unit that calculates a half-value width of a representative peak selected from peaks of the mass spectrum; and a control unit that determines a measurement method for use in a next round of measurement, on the basis of the total amount of ion and the half-value width of the representative peak;

wherein the control unit determines the stability of an ion source constituting the mass analysis unit on the basis of a result of comparison of a statistical amount of a plurality of total amounts of ion output from the mass analysis unit operated with a specific measurement parameter with a third threshold value.

8. The mass spectrometer device according to claim 7, wherein when a maximum value of the plurality of total amounts of ion is zero, the control unit sets the statistical amount to zero; and when the maximum value of the plurality of total amounts of ion is not zero, the control unit sets a value obtained by dividing a minimum value of the plurality of total amounts of ion by the maximum value as the statistical amount.

9. The mass spectrometer device according to claim 7, wherein the control unit, upon determining that the operation of the ion source is unstable, executes a control operation for stabilizing the ion source;

upon determining that the operation of the ion source is stable, the control unit determines the state of the current round of measurement on the basis of a combination of a result of comparison of the total amount of ion measured with respect to the mass spectrum with one or a plurality of first threshold values, and a result of comparison of the half-value width of the representative peak measured with respect to the mass spectrum with one or a plurality of second threshold values.

10. The mass spectrometer device according to claim 9, wherein a third calculation unit that executes a predetermined determination process on the basis of the mass spectrum does not execute the determination process or does not output a result of the determination process when it is determined that the operation of the ion source is unstable.

11. The mass spectrometer device according to claim 1, wherein the control unit determines the appropriateness of the amount of ion in the ion trap constituting the mass analysis unit on the basis of a result of comparison of a maximum intensity of the mass spectrum and a detectable upper limit value of a detector constituting the mass analysis unit.

12. The mass spectrometer device according to claim 11, wherein the control unit, when the maximum intensity corresponds to the upper limit value, executes a process for decreasing the amount of ion in the ion trap as the measurement method for use in the next round of measurement.

13. A mass spectrometer device comprising:

a mass analysis unit;

a first calculation unit that calculates a total amount of ion in a mass spectrum output from the mass analysis unit;

a second calculation unit that calculates a half-value width of a representative peak selected from peaks of the mass spectrum;

a control unit that determines a measurement method for use in a next round of measurement on the basis of the total amount of ion and the half-value width of the representative peak and issues an instruction to the mass analysis unit; and a user interface unit;

wherein the second calculation unit calculates a half width at half maximum with respect to each of a low-mass side and a high-mass side of a top of the representative peak, and considers a value twice a value of the smaller of the half widths at half maximum to be the half-value width.

14. A mass analysis method comprising:

a process of a first calculation unit calculating a total amount of ion in a mass spectrum output from a mass analysis unit;

a process of a second calculation unit calculating a half-value width of a representative peak selected from peaks appearing in the mass spectrum; and a process of a control unit determining a measurement method for use in a next round of measurement on the basis of the total amount of ion and the half-value width of the representative peak;

wherein the second calculation unit calculates a half width at half maximum with respect to each of a low-mass side and a high-mass side of a top of the representative peak, and considers a value twice a value of the smaller of the half widths at half maximum to be the half-value width.

* * * * *